United States Patent [19]

Suenaga et al.

[11] 4,078,466

[45] Mar. 14, 1978

[54] PULSATO GENERATING SYSTEM

[75] Inventors: Norboru Suenaga, Ageo; Toru Tsurubuchi, Tokyo, both of Japan

[73] Assignee: Roland Corporation, Osaka, Japan

[21] Appl. No.: 649,821

[22] Filed: Jan. 16, 1976

[30] Foreign Application Priority Data

| | | |
|---|---|---|
| Jan. 18, 1975 | Japan | 50-8114 |
| Jan. 18, 1975 | Japan | 50-8115 |
| Jan. 20, 1975 | Japan | 50-8555 |
| Jan. 20, 1975 | Japan | 50-8556 |

[51] Int. Cl.[2] ..... G10H 1/02

[52] U.S. Cl. ..... 84/1.24; 84/1.01; 84/1.03; 84/1.25; 84/DIG. 4

[58] Field of Search ..... 84/1.01, 1.03, 1.24, 84/1.25, DIG. 4; 179/1 G, 1 GA; 332/23 R, 23 A, 68

[56] References Cited

U.S. PATENT DOCUMENTS

| | | | |
|---|---|---|---|
| 2,916,706 | 12/1959 | Timperman | 84/1.24 X |
| 3,004,460 | 10/1961 | Wayne | 84/1.01 |
| 3,007,361 | 11/1961 | Wayne | 84/DIG. 4 |
| 3,624,266 | 11/1971 | Sharp | 84/1.24 |
| 3,886,835 | 6/1975 | Peterson | 84/DIG. 4 X |

*Primary Examiner*—Ulysses Weldon

*Attorney, Agent, or Firm*—Marshall & Yeasting

[57] ABSTRACT

A pulsato generating system which is composed of a sequentially phase inverting signal generator for producing first, second and third sequentially phase inverting signals based on an input musical signal, a phase rotating signal generator for producing first and second phase rotating signals based on the first, second and third sequentially phase inverting signals and first and second speakers respectively supplied with the first and second phase rotating signals.

Another pulsato generating system is disclosed which is composed of the abovesaid sequentially phase inverting signal generator and first, second and third speakers respectively supplied with the first, second and third sequentially phase inverting signals derived from the sequentially phase inverting signal generator.

Another pulsato generating system is disclosed which has a chorus signal generator for producing from the input signal a chorus signal producing a chorus effect and in which the chorus signal is used as an input musical signal to the abovesaid pulsato generating systems.

Further, a signal generator for pulsato is disclosed which is composed of a phase shifter, a gate signal generator, a gate unit, a modulating signal generator and an amplitude modulating and synthesizing circuit.

9 Claims, 15 Drawing Figures

MUSIC SIGNAL SOURCE
PHASE SHIFTER
GATE
GATE SIGNAL GEN.
CONTROL SIGNAL GENERATOR
MODULATION GENERATOR
SYNTHESIZER

MUSIC SIGNAL SOURCE
1
A
21
22
23a
23b
B
24
CHORUS SIGNAL GENERATOR
C
2
PHASE SHIFTER
GATES
MODULATION AMPLIFIERS
J1
J3
J2
14
SYNTHESIZER
K1
K2
17a
17b
18a
18b
F
7
CONTROL SIGNAL GENERATOR
D
25
SIGNAL GENERATOR

MUSIC SIGNAL SOURCE
1
A
CHORUS SIGNAL GENERATOR
32
C'
21
23b
23a
23c
24
22
22'
B
B'
C
CHORUS SIGNAL GENERATOR
D
D'
25
25'
SIGNAL GENERATORS
2
PHASE SHIFTER
GATES
MODULATION AMPLIFIERS
F
7
CONTROL SIGNAL GENERATOR
J1
J3
J2
14
K1
K2
17a
17c
17b
18a
18c
18b
SYNTHESIZER

PULSATO GENERATING SYSTEM

BACKGROUND OF THE INVENTION

1. Field of the Invention

This invention relates to a pulsato generating system for producing sounds which provide a pulsato effect or the pulsato effect with a chorus effect.

1. Description of the Prior Art

By reproducing first and second phase rotating signals based on a musical signal, for example, from an electronic musical instrument by first and second speakers, it is possible to produce sounds which provide a pulsato effect. The first phase rotating signal rotates its phase at a relatively low speed in such a direction 0-$\pi/2$-$\pi$-$3\pi/2$ that the amount of phase shift gradually increases. The second phase rotating signal rotates its phase at the same speed as the first phase rotating signal in such a direction $\pi$-$\pi/2$-0-$3\pi/2$ that the amount of phase shift gradually decreases.

When first, second and third sequentially phase inverting signals based on a musical signal, for example, from an electronic musical instrument, are respectively reproduced by first, second and third speakers, it is also possible to produce sounds which provide a pulsato effect. The first sequentially phase inverting signal sequentially inverts its phase between 0 and $\pi$ at a relatively low speed and undergoes such an amplitude change that its amplitude is maximum at the center between the two phase inverting positions and minimum at the phase inverting positions. The second sequentially phase inverting signal sequentially inverts its phase between $\pi$ and 0 in the opposite phase relation to the first sequentially phase inverting signal but at the same speed as the first sequentially phase inverting signal and undergoes the same amplitude change as the latter. The third sequentially phase inverting signal sequentially inverts its phase between $\pi/2$ and $3\pi/2$ while being shifted by $\pi/2$ relative to the first and second sequentially phase inverting signals but at the same speed as the first and second sequentially phase inverting signals. The third sequentially phase inverting signal also undergoes the same amplitude change as the first and second sequentially phase inverting signals.

Further, when a composite signal, which is composed of a musical signal obtained, for example, from an electronic musical instrument, and at least one frequency-modulated signal obtained by frequency modulating the musical signal with a sine-or cosine-wave, i.e. a sinusoidal wave, signal of a relatively low frequency, are reproduced by a speaker, it is possible to produce sounds which provide a chorus effect. Moreover, if the abovesaid first and second phase rotating signals are obtained from the abovesaid composite signal used as an input signal and respectively reproduced by the first and second speakers, it is possible to produce sounds which provide the pulsato effect together with the chorus effect.

Further, if the aforementioned first, second and third sequentially phase inverting signals are obtained from the above said composite signal used as an input signal and respectively reproduced by the first, second and third speakers, it is possible to produce sounds which provide the pulsato effect together with the chorus effect.

Conventional types of pulsato generating systems are defective in that means for generating the abovesaid phase rotating signals, means for the abovesaid sequentially phase inverting signals and means for generating the abovesaid composite signal providing the chorus effect are all complicated and bulky.

SUMMARY OF THE INVENTION

Accordingly, one object of this invention is to provide a novel pulsato generating system capable of generating sounds which produce the pulsato effect without making the phase rotating signal generating means complicated and bulky.

Another object of this invention is to provide a novel pulsato generating system capable of generating sounds which produce the pulsato effect without making the sequentially phase inverting signal generating means complicated and bulky.

Another object of this invention is to provide a novel pulsato generating system capable of generating sounds which produce the pulsato effect together with the chorus effect without making complicated and bulky the phase rotating signal generating means and the means for generating the composite signal producing the chorus effect.

Still another object of this invention is to provide a pulsato generating system capable of generating sounds which produce the pulsato effect together with the chorus effect without making complicated and bulky the sequentially phase inverting signal generating means and the means for generating the composite signal producing the chorus effect.

The pulsato generating system according to this invention has a simple construction that the pulse rotating signal generating means, the sequentially phase inverting means and the means for generating the composite signal producing the chorus effect are constructed purely electronically.

DESCRIPTION OF THE PREFERRED EMBODIMENTS

Figure 1:
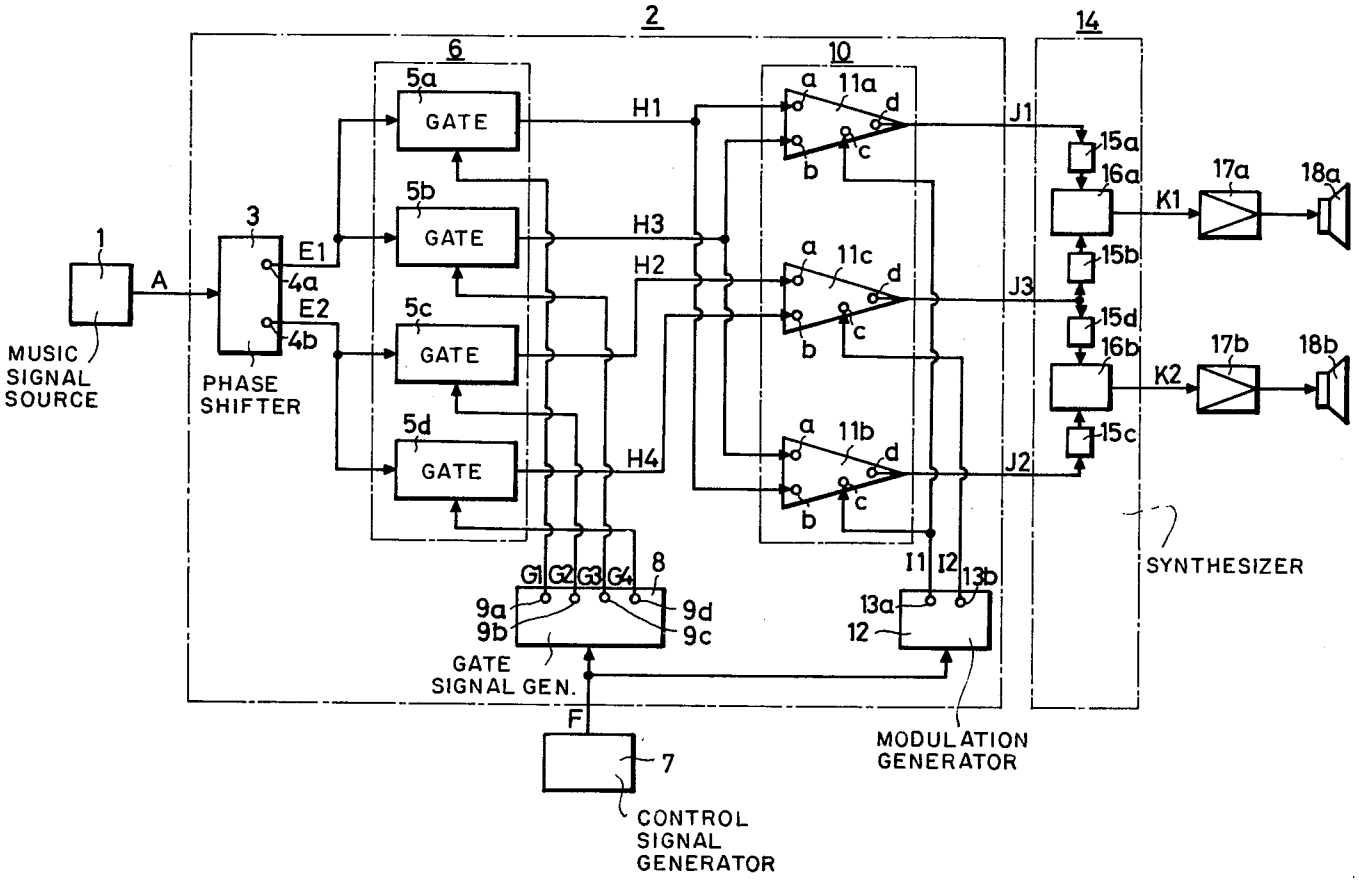
FIG. 1 illustrates a first embodiment of this invention.
Figure 2:
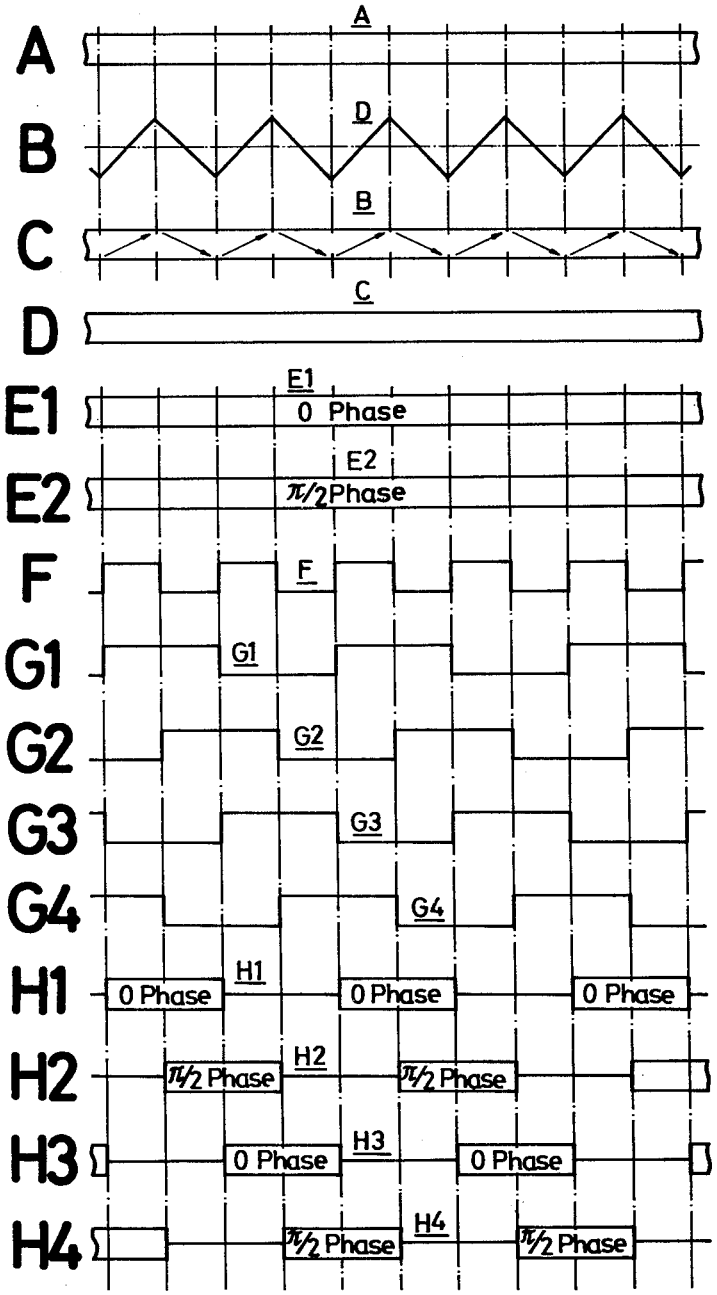
FIG. 2 shows a series of waveform diagrams for explaining this invention.
Figure 2:
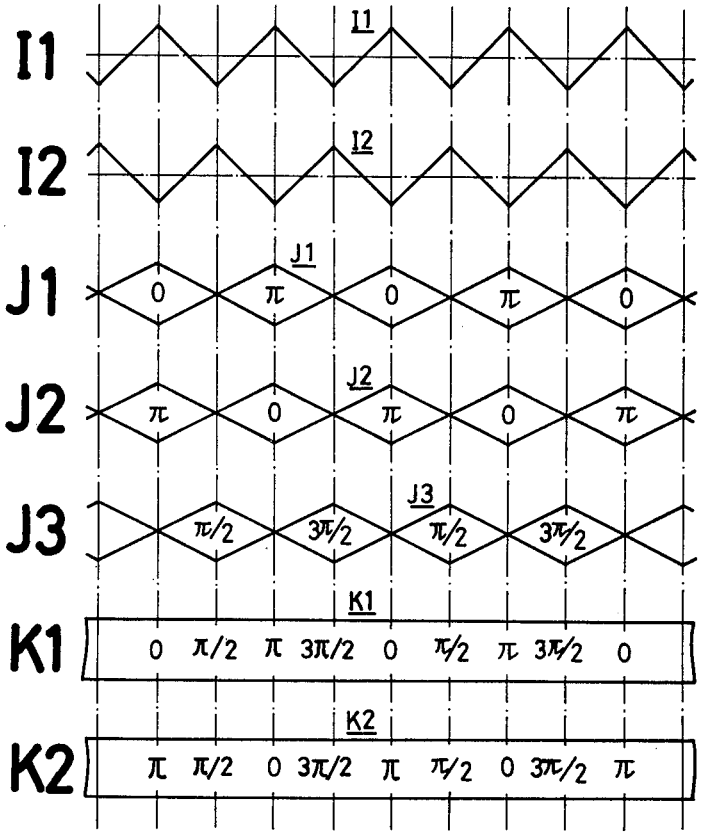

FIG. 1 illustrates a first embodiment of this invention. A musical signal A, shown in FIG. 2A, which is emitted from a musical signal source 1 such, for example, as an electronic musical instrument, is supplied to a phase shifter 3 which forms one part of a sequentially phase inverting signal generator 2. At 0-and $\pi/2$-phase output terminals 4*a* and 4*b* of the phase shifter 3, there are respectively derived 0- and $\pi/2$-phase musical signals E1 and E2 such as shown in FIGS. 2E1 and 2E2 which are phased $\pi/2$ apart. These musical signals E1 and E2 thus obtained are applied to a gate unit 6 which is composed of gate circuits 5*a* and 5*b* for gating the musical signal E1 and gate circuits 5*c* and 5*d* for gating the musical signal E2.

Figure 3:
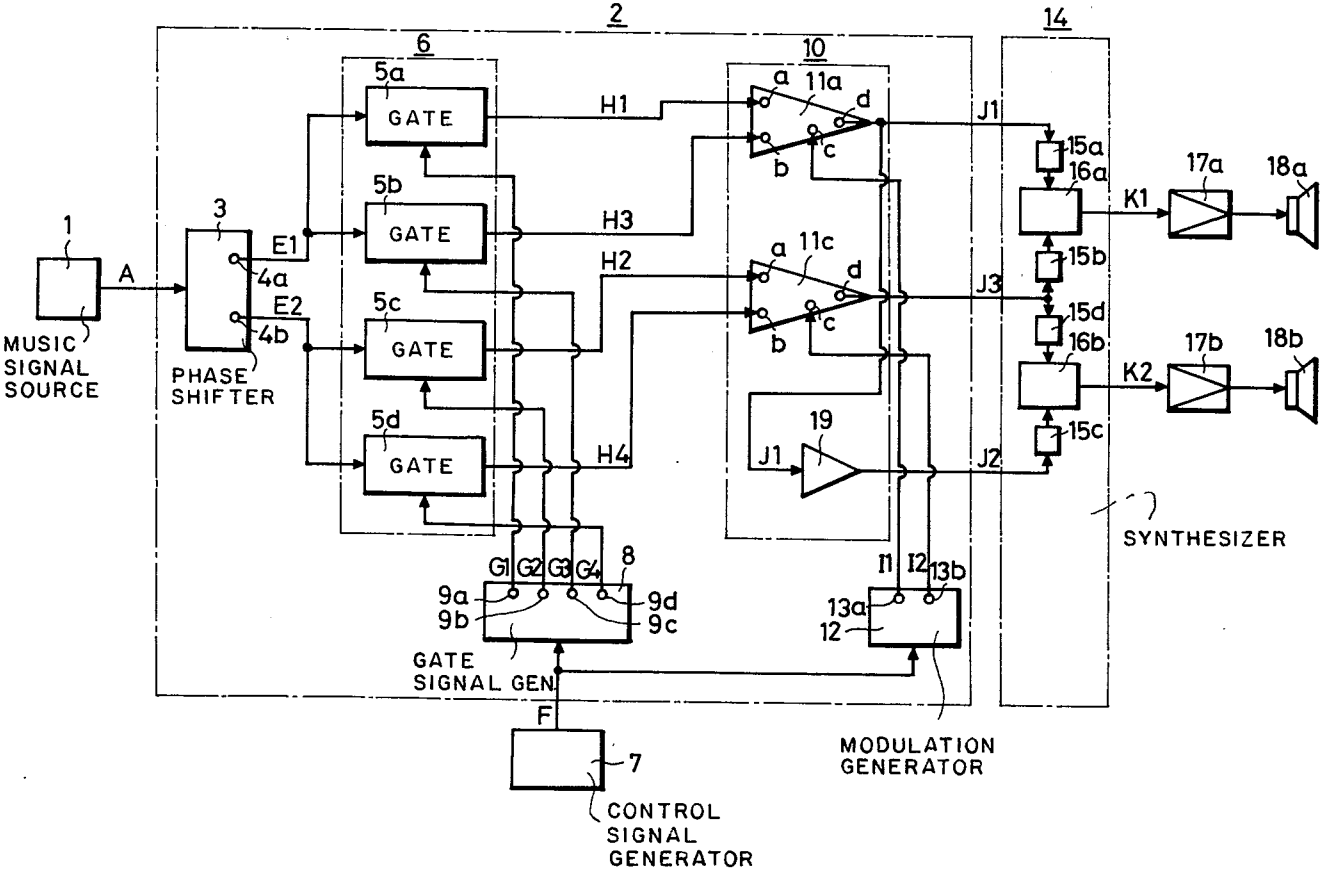
FIGS. 3 to 5 respectively illustrate second, to fourth embodiments of this invention.
Figure 4:
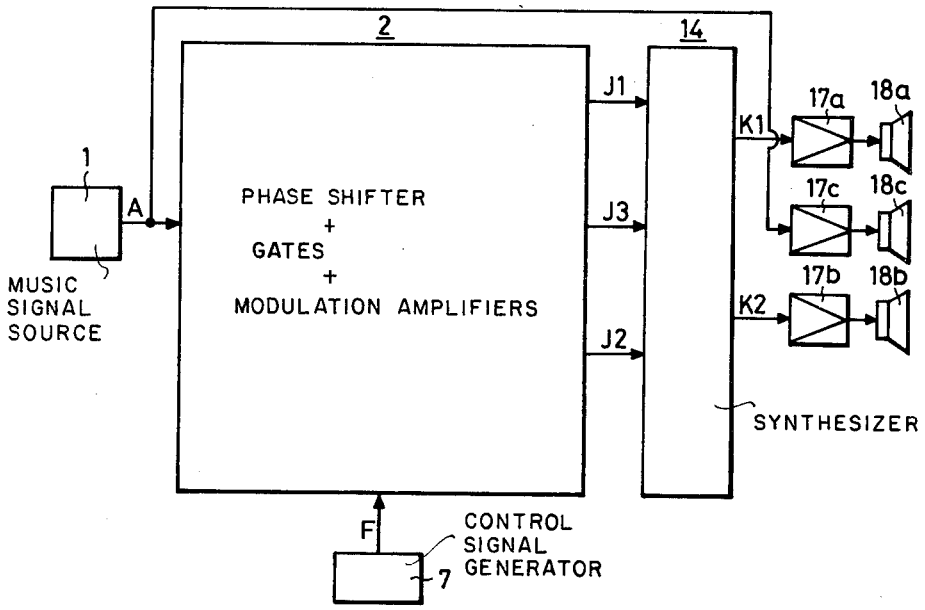

For example, a rectangular control signal F from a control signal source 7, which has a low frequency, for example, lower than 20Hz as shown in FIG. 2F, is applied to a gate signal generator 8. At its 0-, $\pi/2$-, $\pi$- and $3\pi/2$-phase output terminals 9*a*, 9*b*, 9*c* and 9*d* there are respectively derived 0-, $\pi/2$-, $\pi$- and $3\pi/2$-phase gate signals G1, G2, G3 and G4 which have a frequency ½ that of the control signal F and are sequentially phased $\pi/2$ apart as shown in FIGS. 2G1, 2G2, 2G3 and 2G4, respectively. These gate signals G1, G2, G3 and G4 are respectively supplied to the gate circuits 5*a*, 5*c*, 5*b* and 5*d* of the gate unit 6. As a result of this, the gate circuits 5*a* and 5*b* respectively derive therefrom first and second intermittent 0-phase musical signals H1 and H3 that the 0-phase musical signal E1 is gated while the gate signals G1 and G3 are in their on state, as shown in FIGS. 2H1 and 2H3, respectively. And the gate circuits 5*c* and 5*d* respectively derive therefrom first and second intermittent $\pi/2$-phase musical signals H2 and H4 that the $\pi/2$-phase musical signal E2 is gated while the gate signals G2 and G4 are in their on state, as depicted in FIGS. 2H2 and 2H4, respectively. The musical signals H1, H2, H3 and H4 thus obtained are applied to an amplitude modulating and synthesizing unit 10.

One example of the amplitude modulating and synthesizing unit 10 comprises circuits 11*a*, 11*b* and 11*c* of the operational amplifier structure. Each of the circuits 11*a*, 11*b*, and 11*c* has two signal input terminals *a* and *b*, one amplitude modulating signal input terminal *c* and one signal output terminal *d*. In the case where a signal is applied to the signal input terminal *a*, a signal in-phase with the input signal is derived at the output terminal *d* and in the case where a signal is applied to the input terminal *b*, a signal opposite in phase to the input signal is derived at the output terminal *d*. The signal thus obtained at the output terminal *d* is, however, amplitude-modulated by an envelope corresponding to the waveform of a modulating signal fed to the amplitude modulating signal input terminal *c*. The signal input terminals *a* and *b* of each of the circuits 11*a* and 11*b* are supplied with the intermittent 0-phase musical signals H1 and H3, respectively. And the signal input terminals *a* and *b* of the circuit 11*c* are supplied with the intermittent $\pi/2$-phase musical signals H2 and H4, respectively.

The control signal F from the control signal source 7, depicted in FIG. 2F, is applied to a modulating signal generator 12, deriving at its 0- and $\pi$-phase output terminals 13*a* and 13*b* such sine-wave 0- and $\pi$-phase modulating signals I1 and I2 which have the same frequency as the control signal F but are phased $\pi$ apart as shown in FIGS. 2I1 and 2I2, respectively. (In the figures, the sine-wave modulating signals I1 and I2 are shown in the form of triangular waves, for the sake of brevity.) The modulating signal I1 is applied to the amplitude modulating signal input terminals *c* of the circuits 11*a* and 11*b* and the modulating signal I2 is applied to the amplitude modulating signal input terminal *c* of the circuit 11*c*. As a result of this, the circuit 11*a* derives therefrom such a first composite signal J1 as shown in FIG. 2J1 which is composed of a first intermittent 0-phase amplitude-modulated signal that the first intermittent 0-phase musical signal H1 is amplitude modulated by the 0-phase modulating signal 11 and a first intermittent $\pi$-phase amplitude-modulating signal that the second intermittent 0-phase musical signal H3 is amplitude modulated by the 0-phase modulating signal I1 and is phase inverted. In the circuit 11*b*, a second intermittent $\pi$-phase amplitude-modulated signal that the first intermittent 0-phase musical signal H1 is amplitude modulated by the 0-phase modulating signal I1 and is phase inverted, and a second intermittent 0-phase amplitude-modulated signal that the second intermittent 0-phase musical signal H3 is amplitude modulated by the 0-phase modulating signal I1, are combined with each other to provide a second composite signal J2 such as shown in FIG. 2J2. And the circuit 11*c* derives therefrom such a third composite signal J3 as shown in FIG. 2J3 which is composed of an intermittent $\pi/2$-phase amplitude-modulated signal that the first intermittent $\pi/2$-phase musical signal is amplitude modulated by the $\pi$-phase modulating signal I2 and an intermittent $3\pi/2$-phase amplitude-modulated signal that the second intermittent $\pi/2$-phase musical signal is amplitude modulated by the $\pi$-phase modulating signal I2 and is phase inverted. The composite signals J1, J2 and J3 thus obtained are supplied to a phase rotating signal generator 14.

The phase rotating signal generator 14 comprises a synthesizing circuit 16*a* supplied with the composite signals J1 and J3 through level adjusting circuits 15*a* and 15*b*, respectively, and another synthesizing circuit 16*b* supplied with the composite signals J2 and J3 through level adjusting circuits 15*c* and 15*d*, respectively. Accordingly, such as composite signal K1 as depicted in FIG. 2K1 which is composed of the composite signals J1 and J3 and such a composite signal K2 as shown in FIG. 2K2 which is composed of the composite signals J2 and J3, are respectively derived from the synthesizing circuits 16*a* and 16*b*. The composite signals K1 and K2 are respectively supplied to speakers 18*a* and 18*b*, if necessary, through amplifiers 17*a* and 17*b*.

The above is one embodiment of this invention. With such an arrangement, the phase of the composite signal K1 derived from the synthesizing circuit 16*a* based on the musical signal emanating from the musical signal source 1 repeatedly rotates at a relatively low speed in the order 0-$\pi/2$-$\pi$-$3\pi/2$, i.e. in the direction that the amount of phase shift goes on increasing, as depicted in FIG. 2K1. Accordingly, the composite signal K1 can be called a first phase rotating musical signal. The phase of the composite signal K2 from the synthesizing circuit 16*b* repeatedly rotates at the same speed as the phase of the first phase rotating musical signal in the order $\pi$-$\pi/2$-0-$3\pi/2$, i.e. in the direction that the amount of phase shift goes on decreasing, as shown in FIG. 2K2. Accordingly, this signal can be called a second phase rotating musical signal. Such composite signals, that is, the first and second phase rotating musical signals are reproduced by the speakers 18*a* and 18*b*, so that a musical sound can be produced to provide the pulsato effect, based on the musical signal A. Accordingly, the first embodiment of this invention described above is capable of generating a musical sound to provide the pulsato effect with a simple construction as a whole.

Referring now to FIG. 3, a second embodiment of this invention will hereinafter be described. In FIG. 3, parts corresponding to those in FIG. 1 are identified by the same reference numerals and no detailed description will be repeated. The present embodiment is identical in construction with the FIG. 1 embodiment except that an inverter 19 is provided in place of the circuit 11*b* of the amplitude modulating and synthesizing unit 10 and supplied with such a first composite signal J1 from the circuit 11*a* as shown in FIG. 2J1 to provide such a second composite signal J2 as depicted in FIG. 2J2.

The above is the second embodiment of this invention. It is evident that the same results as those obtainable with the FIG. 1 embodiment can be obtained.

Turning now to FIG. 4, a third embodiment of this invention will be described. In this embodiment, parts corresponding to those in FIG. 1 or 3 are marked with the same reference numerals and no detailed description will be given. The present embodiment is also identical in construction with the FIG. 1 or 3 embodiment except that a third speaker 18*c* is provided in addition to the speakers 18*a* and 18*b* and supplied with the musical signal A from the musical signal source 1. if necessary, through an amplifier 17*c*.

The above is a third embodiment of this invention. With such an arrangement, the musical sound based on the musical signal A from the musical signal source 1 is reproduced by reproducing the phase rotating musical signals K1 and K2 by the speakers 18*a* and 18*b* to produce the pulsato effect and, at the same time, the musical signal A from the musical signal source 1 is directly reproduced by the third speaker 18*c*. Consequently, the musical sound producing the pulsato effect which is obtainable with the FIG. 1 embodiment can be obtained to enhance the richness of the resultant sound.

Accordingly, the third embodiment of this invention described above is capable of producing the musical sound with enhanced richness only by the additional provision of the third speaker in the construction of FIG. 1 or 3.

Figure 5:
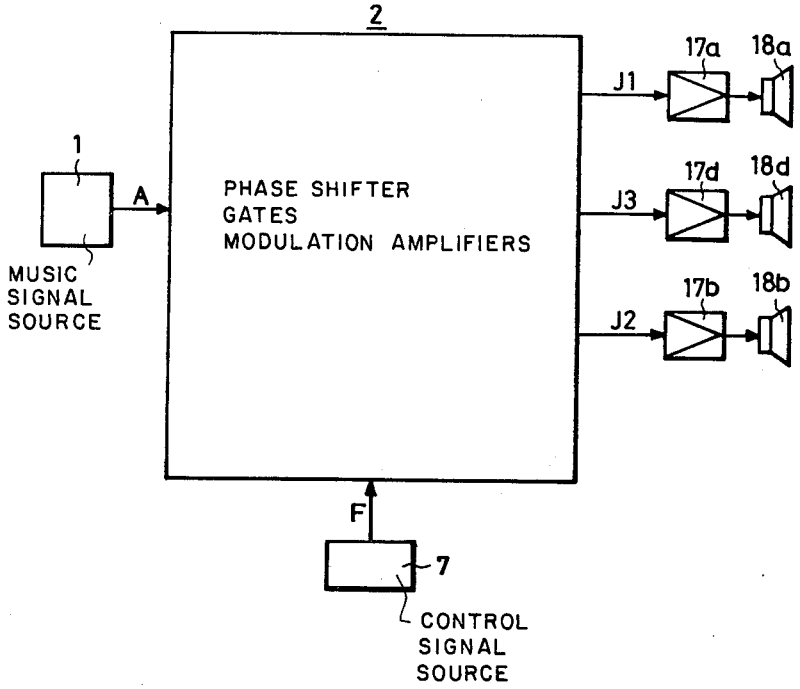

Turning next to FIG. 5, a fourth embodiment of this invention will be described. In FIG. 5, parts corresponding to those in FIG. 1 or 3 are identified by the same reference numerals and no detailed description will be repeated. The present embodiment is also identical in construction with the FIG. 1 or 3 embodiment except that the phase rotating signal generator 14 is omitted, that a third speaker 18*d* is provided in addition to the speakers 18*a* and 18*b* and that the speakers 18*a*, 18*b* and 18*d* are respectively supplied with the composite signals J1, J2 and J3 from the sequentially phase inverting signal generator 2.

The above is the fourth embodiment of this invention. With such a construction, the composite signal J1, derived from the sequentially phase inverting signal generator 2 based on the musical signal A from the musical signal source 1, repeatedly inverts its phase between 0 and $\pi$ at a relatively low speed as shown in FIG. 2J1 and undergoes such an amplitude change which presents its maximum amplitude value at the center between the two phase inverting positions and its minimum amplitude value at each phase inverting position. Accordingly, this signal can be called a first sequentially phase inverting musical signal. The composite signal J2 repeatedly inverts its phase between $\pi$ and 0 in an opposite phase relation to the first sequentially phase inverting musical signal J1 but at the same speed as the latter and undergoes the same amplitude change as the latter, as shown in FIG. 2J2. Accordingly, this can be called a second sequentially phase inverting signal. Further, the third composite signal J3 also repeatedly inverts its phase between $\pi/2$ and $3\pi/2$ at the same speed as the first and second sequentially phase inverting musical signals but the phase of this third composite signal is shifted by $\pi/2$ relative to the phase of the first and second sequentially phase inverting signals, as depicted in FIG. 2J3. And the third composite signal J3 undergoes the same amplitude change as the first and second sequentially phase inverting signals. Accordingly, the third composite signal can be called a third sequentially phase inverting musical signal. These composite signals J1, J2 and J3, that is, the first, second and third sequentially phase inverting musical signals are respectively reproduced by the speakers 18*a*, 18*b*, and 18*c*. In this case, if the speaker 18*d* is disposed between the speakers 18*a* and 18*b* as shown in FIG. 5, there is provided in front of the speakers 18*a*, 18*b* and 18*d* a reproduced sound which is composed of sound reproduced by the speaker 18*a* based on the composite signal J1 and a sound reproduced by the speaker 18*d* based on the composite signal J3. And the reproduced sound thus obtained is equivalent to the reproduced sound by the speaker 18*a* based on the composite signal K1, described above in connection with FIG. 2K1, i.e. the first sequentially phase inverting musical signal in FIG. 1 or 3. Further, a reproduced sound is obtained which is composed of a sound reproduced by the speaker 18*b* based on the composite signal J2 and the sound reproduced by the speaker 18*d* based on the composite signal J3. And this reproduced sound is equivalent to the reproduced sound by the speaker 18*b* based on the composite signal K2 described previously with regard to FIG. 2K2, i.e. the second sequentially phase inverting musical signal in FIG. 1 or 3.

Accordingly, with the fourth embodiment of this invention, it is also possible to produce musical sounds to provide the pulsato effect based on the musical signal A.

Figure 6:
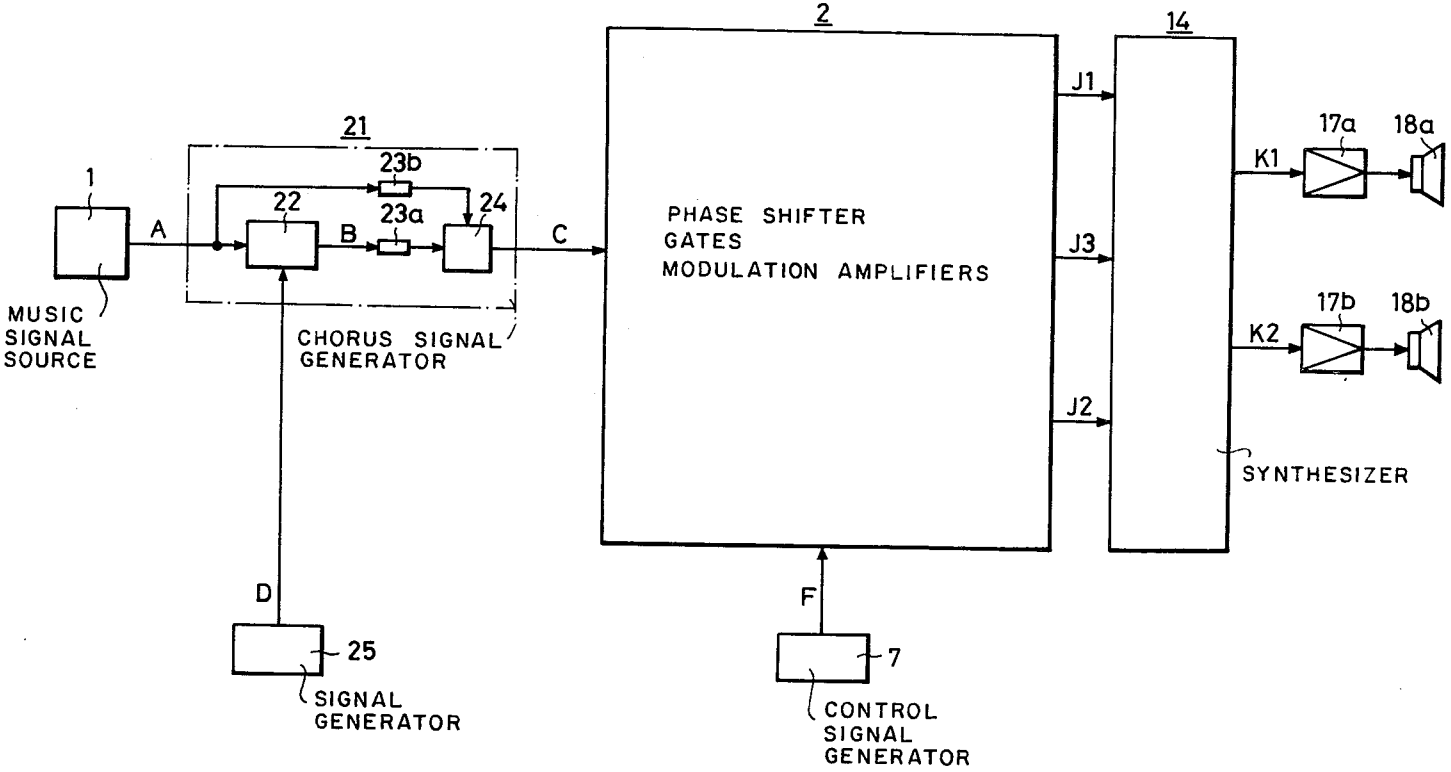
FIGS. 6 to 13 respectively show fifth to twelfth embodiments of this invention.

FIG. 6 shows a fifth embodiment of this invention. In FIG. 6, parts corresponding to those in FIG. 1 or 3 are identified by the same reference numerals and no detailed description will be given. This embodiment is identical in construction with the FIG. 1 or 3 embodiment except that the sequentially phase inverting signal generator 2 is supplied with a chorus signal C derived from a chorus signal generator 21 in place of the musical signal A. In this case, the chorus signal generator 21 comprises a frequency modulator 22 supplied with the musical signal A from the musical signal source 1 to frequency modulate it to provide a frequency-modulated signal (hereinafter identified by B) and a synthesizing circuit 24 supplied with the frequency-modulated signal B and the musical signal A through level adjusting circuits 23*a* and 23*b* respectively to combine them with each other to provide a composite signal as the chorus signal C. To the frequency modulator 22 is applied from a modulating signal source 25 such a sinusoidal or cosine-wave (shown in the form of triangular waves for convenience of illustration) modulating signal D) as shown in FIG. 2B which has a low frequency, for example, less than 20Hz. Accordingly, the frequency-modulated signal B from the frequency modulator 22 is obtained in such a mode that if the frequency of the musical signal A is assumed to be constant in each period of the modulating signal D as shown in FIG. 2C, the frequency of the frequency-modulated signal B is gradually shifted, for example, upwardly relative to the constant frequency, thence gradually shifted downwardly to the reference frequency, thence gradually shifted downwardly and thence gradually shifted upwardly to the reference frequency. The chorus signal C from the synthesizing circuit 24 is composed of the frequency-modulated signal B thus obtained and the musical signal A derived from the musical signal source 1. The chorus signal C is shown in the form of one band in FIG. 2D. The amount of upward and downward frequency deviation of the frequency-modulated signal B is selected to be, for example, lower than 20Hz. By reproducing such a chorus signal C with a speaker, it is possible to produce sounds which provide a chorus effect.

The above is the fifth embodiment of this invention. With such a construction as described above, the phase-rotating composite signals K1 and K2 from the phase rotating signal generator 14, such as depicted in FIGS. 2K1 and 2K2, are obtained based on the chorus signal C from which can be produced sounds providing the chorus effect, and such composite signals K1 and K2 are respectively reproduced by speakers 18*a* and 18*b*. Consequently, it is possible to provide sounds which produce the pulsato effect together with the chorus effect. Namely, this embodiment has the advantage that such sounds can be produced with a simple construction of providing the simple-structured chorus signal generator 21 between the musical signal source 1 and the sequentially phase inverting signal generator 2 in the construction described previously in connection with FIGS. 1 or 3.

Figure 7:
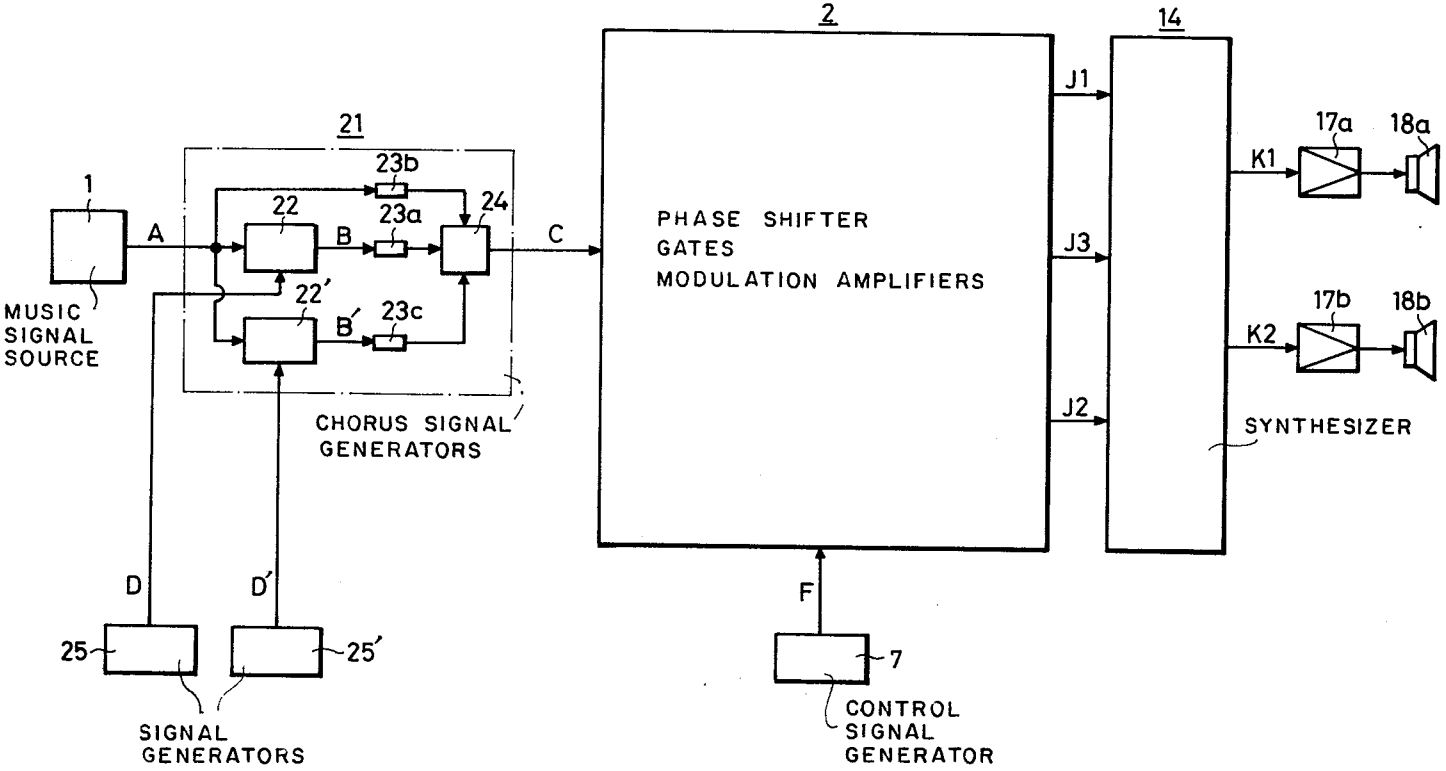

Turning now to FIG. 7, a sixth embodiment of this invention will be described. In FIG. 7 parts corresponding to those in FIG. 6 are marked with the same reference numerals and no detailed description will be repeated. This embodiment is identical in construction with the fifth embodiment except in the following points. Namely, in the construction described above with regard to FIG. 6, the chorus signal generator 21 is provided with another frequency modulator 22′ which is supplied with the musical signal A as is the case with the frequency modulator 22. The frequency modulator 22′ is supplied with a sinusoidal-wave modulating signal D′ of a low frequency less than 20Hz from another modulating signal source 25′ similar to the modulating signal source 25 (The modulating signal D′ is different in frequency and in phase from the modulating signal D derived from the modulating signal source 25.). Accordingly, in the frequency modulator 25′, the musical signal A is frequency modulated to produce a frequency-modulated signal B′ similar to the frequency-modulated signal B derived from the frequency modulator 25. The frequency-modulated signal B′ thus obtained is applied though a level adjusting circuit 23*c* to the synthesizing circuit 24 to derive therefrom a chorus signal C composed of the musical signal A and the frequency-modulated signals B and B′.

The above is the sixth embodiment of this invention. With such a construction, the chorus signal C derived from the chorus signal generator 21 is composed of the frequency-modulated signal B′ in addition to the chorus signal C obtained in the fifth embodiment of this invention described proviously in connection with FIG. 6. Accordingly, if the chorus signal C in the fifth embodiment is called a two-dimension chorus signal, the chorus signal C in the sixth embodiment can be called a three-dimension chorus signal. Therefore, in accordance with the sixth embodiment of this invention, it is possible to obtain sounds which produce a chorus effect different from that in the fifth embodiment and the same pulsato effect as that in the fifth embodiment. And such sounds can be obtained with such a simple construction of providing the frequency modulator 22′ in the construction of FIG. 6.

Figure 8:
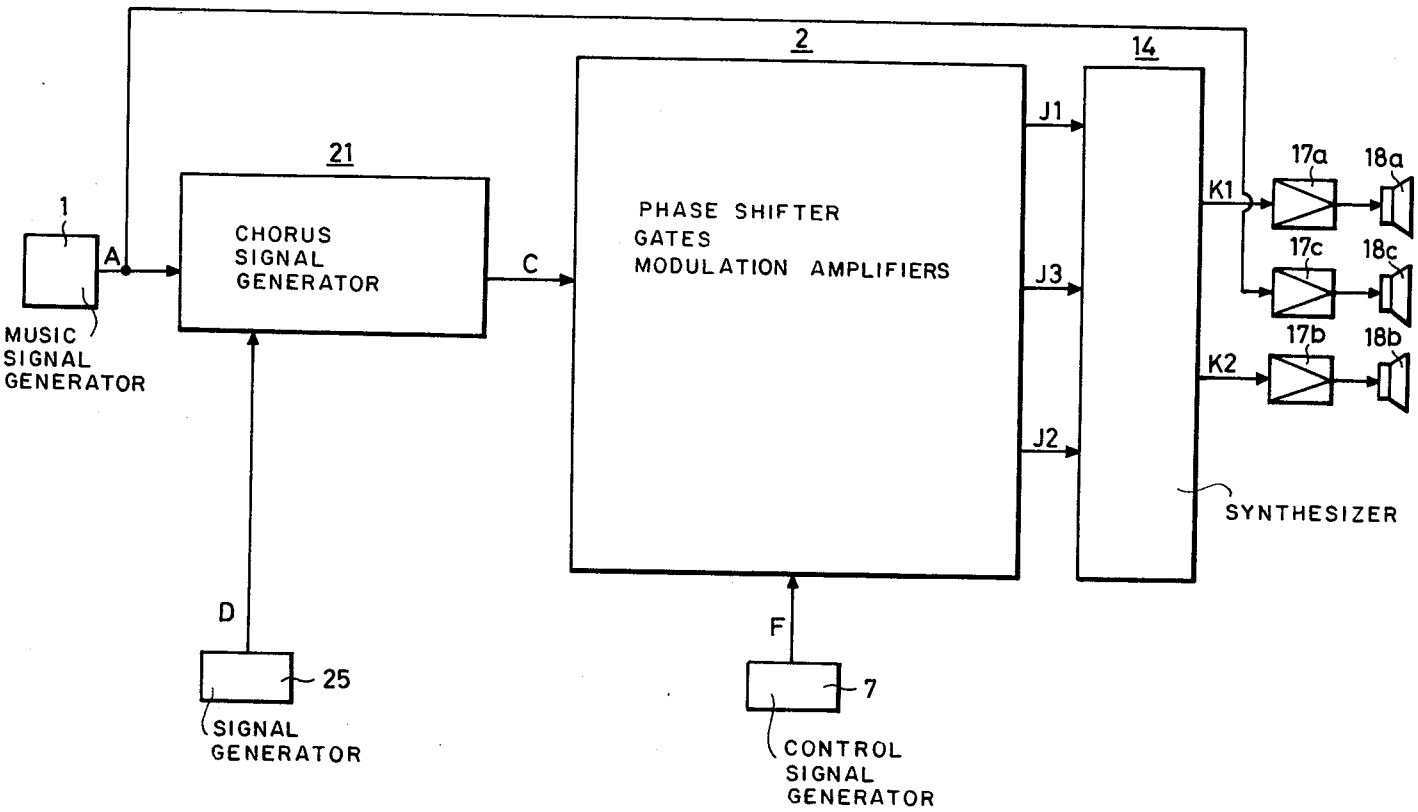

FIG. 8 shows a seventh embodiment of this invention. In FIG. 8, parts corresponding to those in FIG. 6 are marked with the same reference numerals and no detailed description will be repeated. The present embodiment is identical in construction with the FIG. 6 embodiment except that a third speaker 18*c* is provided in addition to the speakers 18*a* and 18*b* and supplied with the musical signal A from the musical signal source 1, if necessary, through an amplifier 17*c*.

The above is the seventh embodiment of this invention. With such an arrangement, sounds based on the musical signal A from the musical signal source 1, which produce the pulsato effect, are obtained by reproducing the phase rotating musical signals K1 and K2 with the speakers 18*a* and 18*b* and, at the same time, the musical signal A from the musical signal source 1 is also directly reproduced by the third speaker 18*c*. As a result of this, the sounds which produces the chorus effect in addition to the pulsato effect, obtained in the FIG. 6 embodiment, can be produced with enhanced richness.

Accordingly, the seventh embodiment of this invention described above has advantages that the sounds producing the pulsato effect together with the chorus effect can be produced with enhanced richness and that such sounds can be obtained with a simple construction only requiring the additional provision of the third speaker in the construction of FIG. 6.

Figure 9:
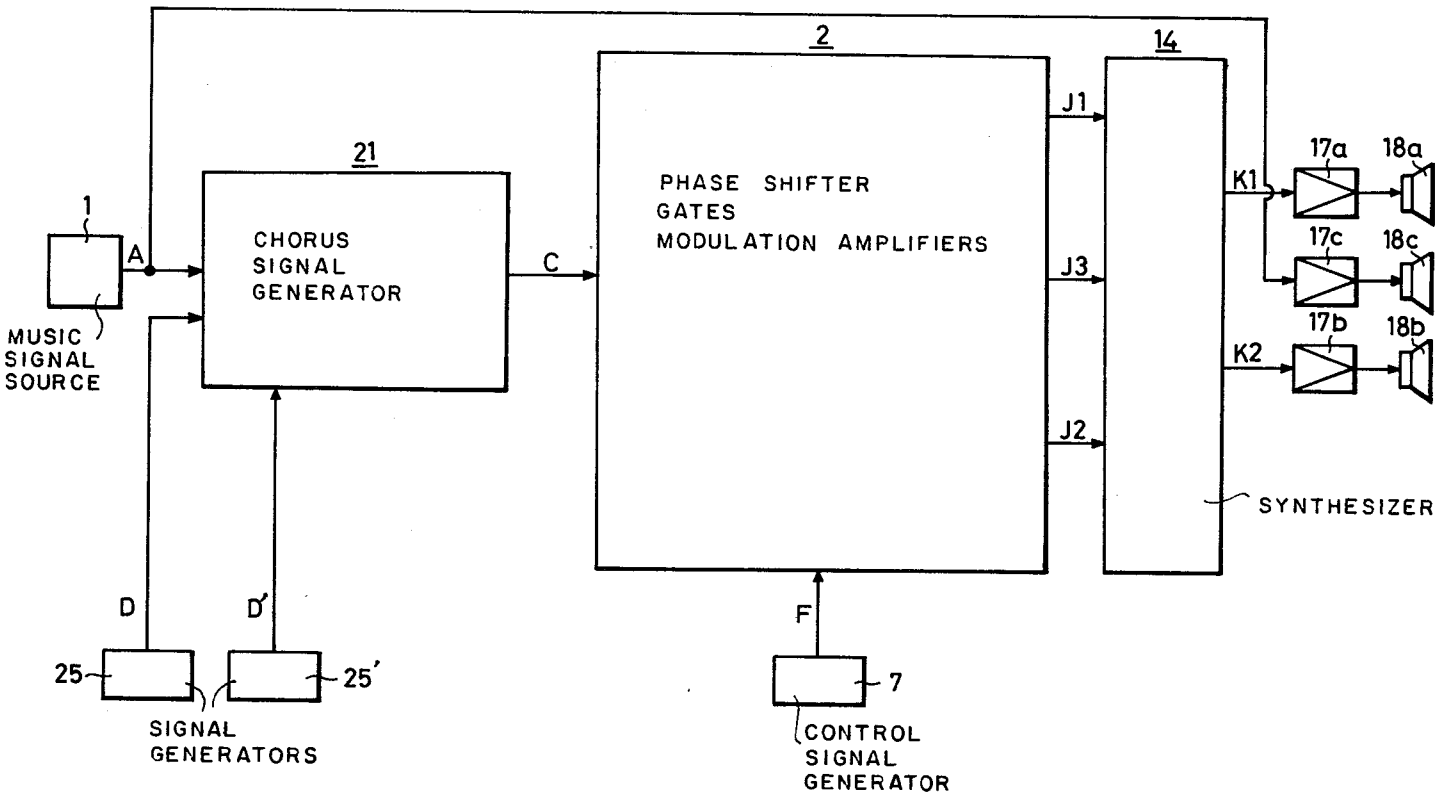

FIG. 9 illustrates an eighth embodiment of this invention. This embodiment is identical in construction with the FIG. 7 embodiment except that the musical signal A from the musical signal source 1 is supplied to the speaker 18*c*, if necessary, through the amplifier 17*c*, as is the case with the FIG. 8 embodiment. With this embodiment, sounds producing the pulsato effect together with the chorus effect can be obtained with enhanced richness as in the case of the FIG. 7 embodiment, although no detailed description is given.

Figure 10:
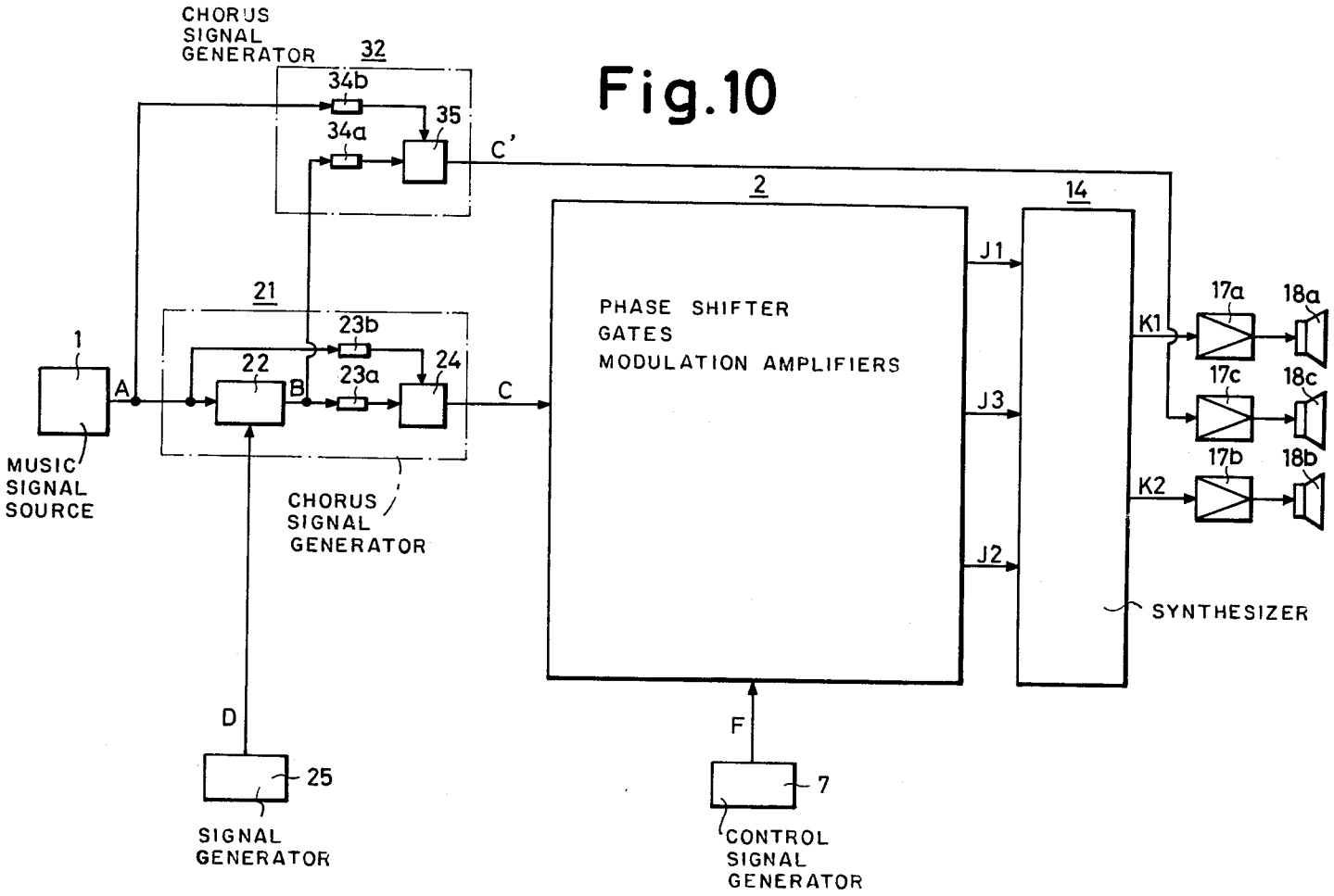

FIG. 10 shows a ninth embodiment of this invention, which is a modified form of the FIG. 8 embodiment. That is, a chorus signal generator 32 is provided which is designed so that the musical signal A from the musical signal source 1 and the frequency-modulated signal B from the frequency modulator 22 of the chorus signal generator 21 are respectively supplied through level adjusting circuits 34*a* and 34*b* to a synthesizing circuit 35 and are combined thereby with each other to provide a composite signal, i.e. a chorus signal C′ similar to the chorus signal C obtained from the synthesizing circuit 24 of the circuit 21. The chorus signal C′ thus obtained is supplied to the third speaker 18*c*, if necessary, through the amplifier 17*c* as is the case with the FIG. 9 embodiment. In this case, the sounds producing the pulsato effect together with the chorus effect can be provided in a tone different from that in the case of FIG. 8.

Figure 11:
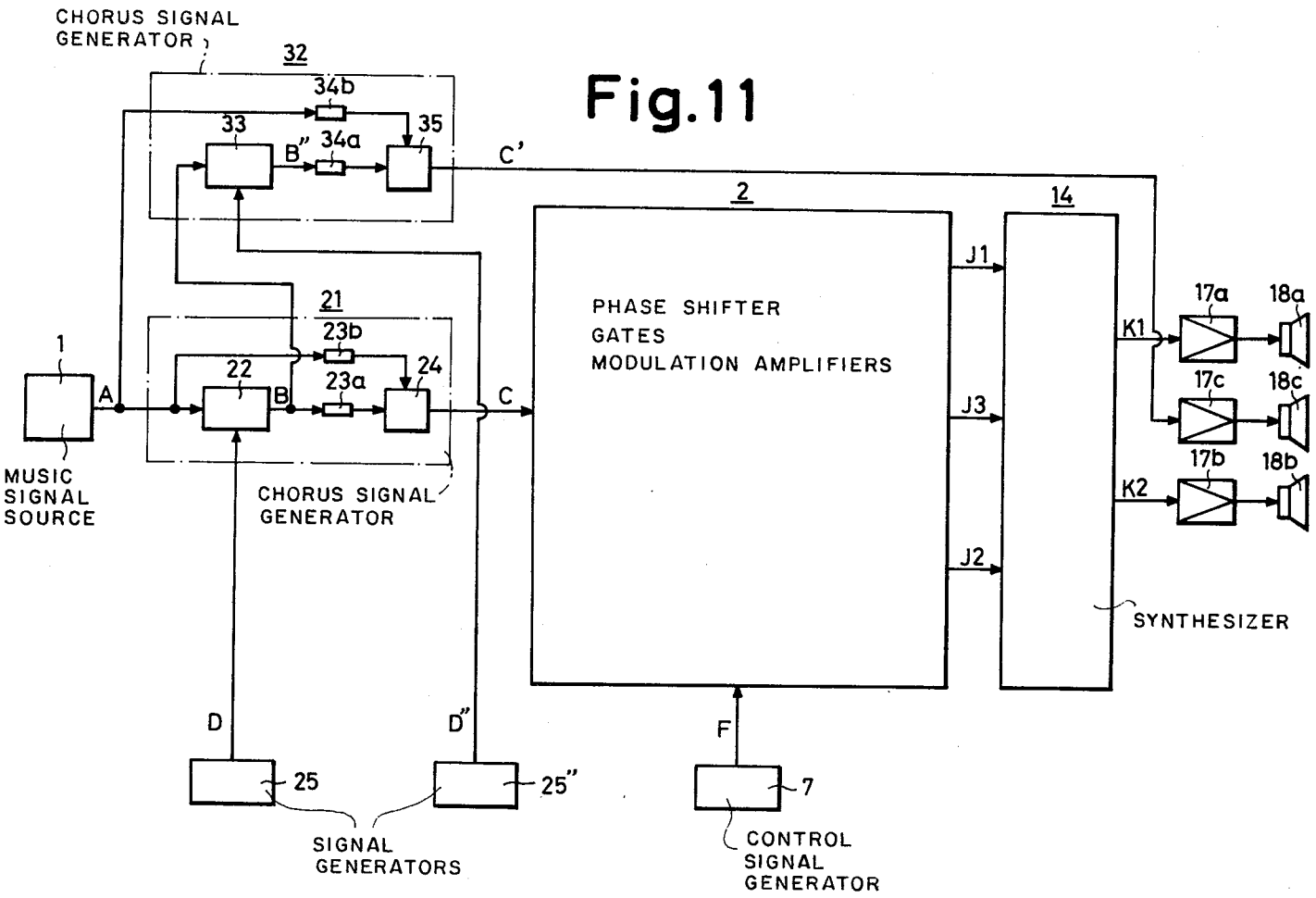

FIG. 11 shows a tenth embodiment of this invention, which is another modified form of the embodiment depicted in FIG. 10. This embodiment employs another chorus signal generator 32 provided with a frequency modulator 33. To the frequency modulator 33 is supplied from another modulating signal source 25″ similar to the modulating signal source 25 sinusoidal-wave modulating signal D″ of a low frequency less than 20Hz. And in the frequency modulator 33, the frequency-modulated signal B derived from the frequency modulator 22 of the chorus signal generator 21 is frequency modulated by the modulating signal D″ in the same manner that the musical signal A is frequency modulated by the modulating signal D. Then, the resultant frequency-modulated signal B″ derived from the frequency modulator 33 and the musical signal A are respectively applied through level adjusting circuits 34*a* and 34*b* to a synthesizing circuit 35 and combined together thereby to provide a chorus signal C′ which is different from the chorus signal from the synthesizing circuit 24 of the circuit 21. The chorus signal C′ thus obtained is applied to the third speaker 18*c*, if necessary, through the amplifier 17*c*, as in the case of FIG. 10. Thus, the sounds producing the pulsato effect together with the chorus effect can be provided in a tone different from those in the cases of FIG. 10.

Figure 12:
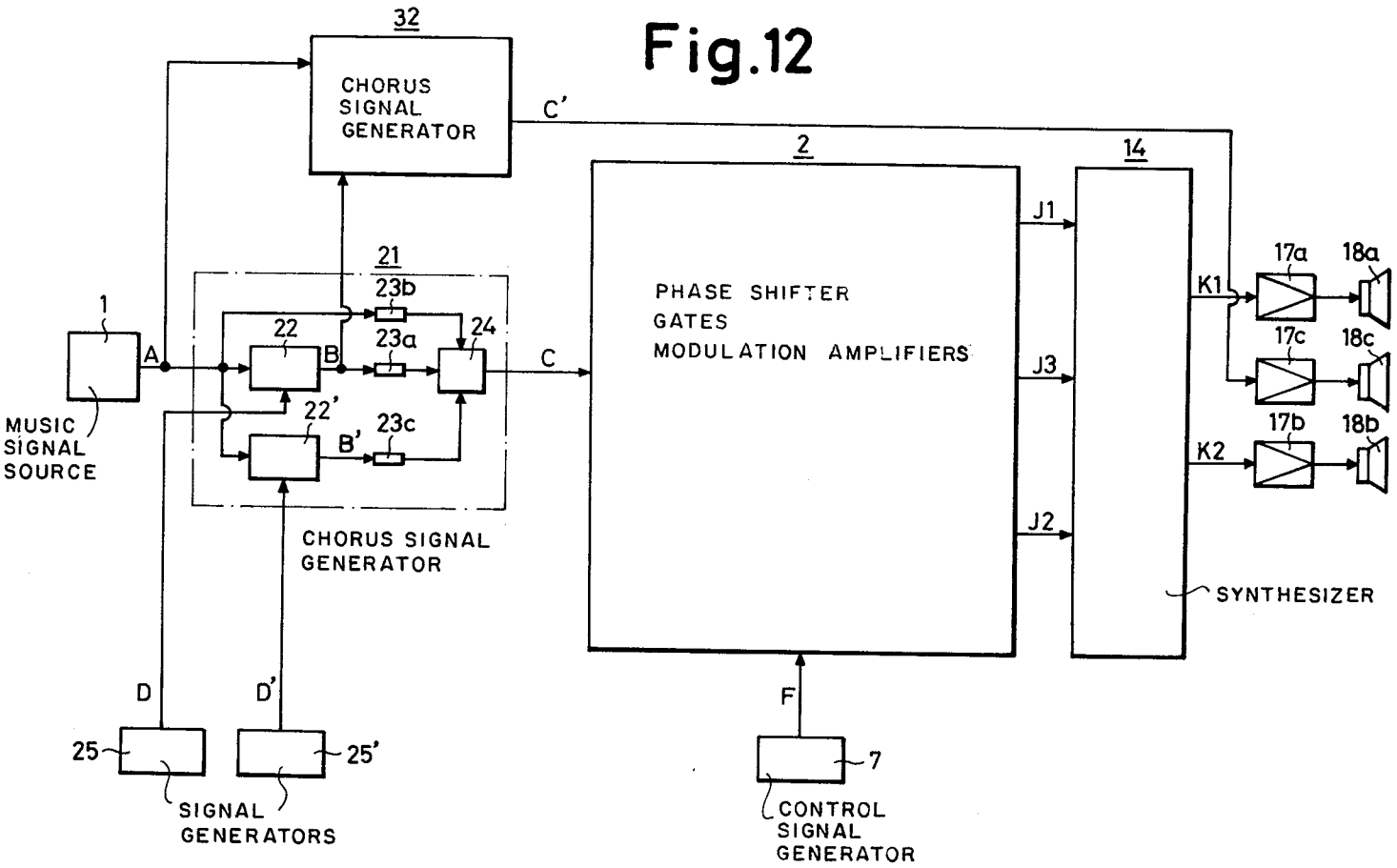

FIG. 12 shows an eleventh embodiment of this invention, which is a modification of the FIG. 9 embodiment. Namely, a chorus signal generator 32 is provided which is similar to that employed in FIG. 10 and a chorus signal C′ obtained from the chorus signal generator 32 is supplied to the speaker 18*c* through the amplifier 17*c* as is the case with FIG. 9. Thus, the sounds which provide the pulsato effect together with the chorus effect can be produced with enhanced richness and in a tone different from that in the case of FIG. 9.

Figure 13:
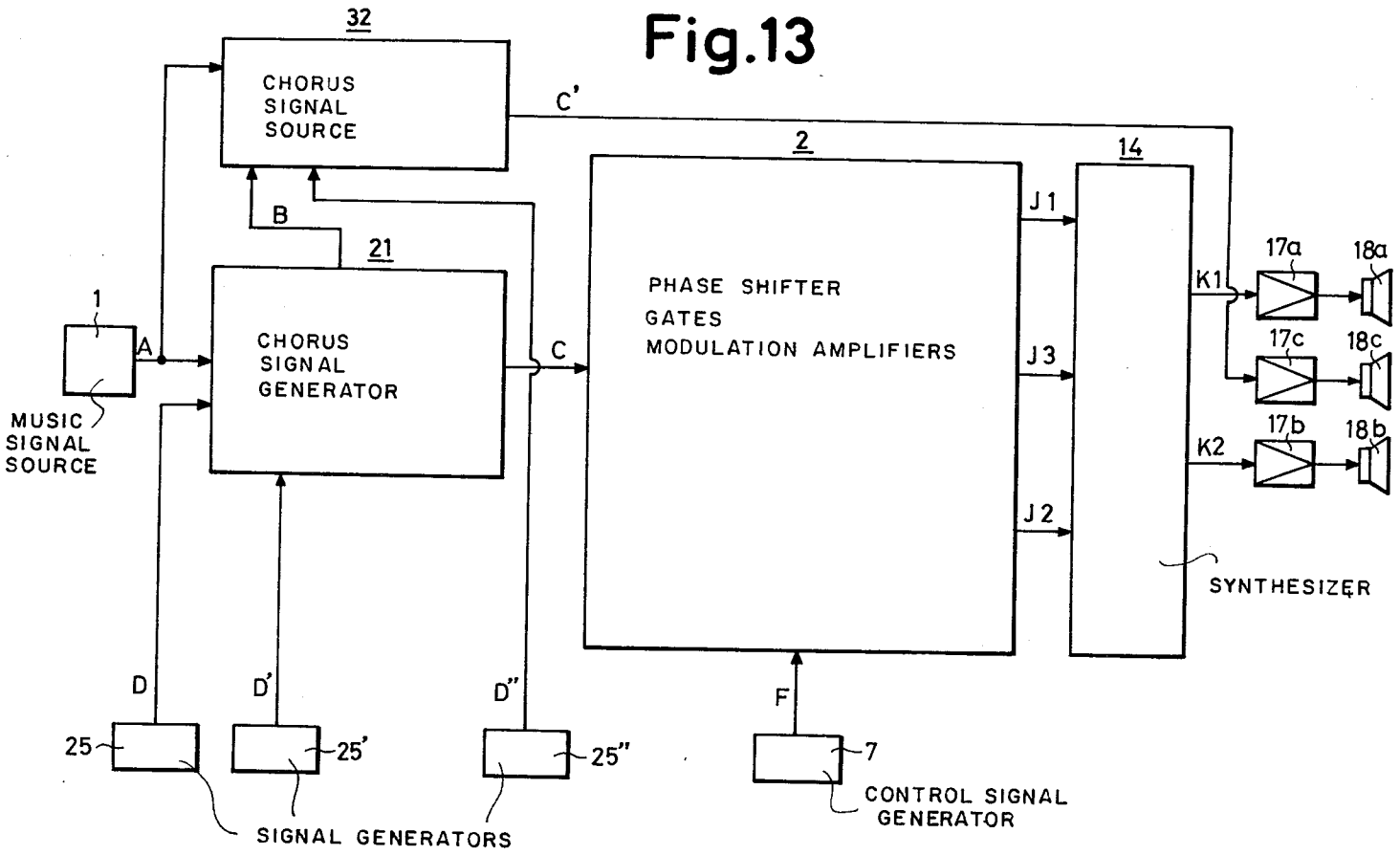

FIG. 13 illustrates a twelfth embodiment of this invention, which is another modification of the FIG. 7 embodiment. Namely, a chorus signal generator 32 is provided which is similar to that used in FIG. 11 and a chorus signal C′ obtained from the chorus signal generator 32 is applied to the speaker 18*c* through the amplifier 17*c* as in the case of FIG. 10. Thus, the sounds which provide the pulsato effect together with the chorus effect can be produced with enhanced richness and in a tone different from those in the case of FIG. 7.

Figure 14:
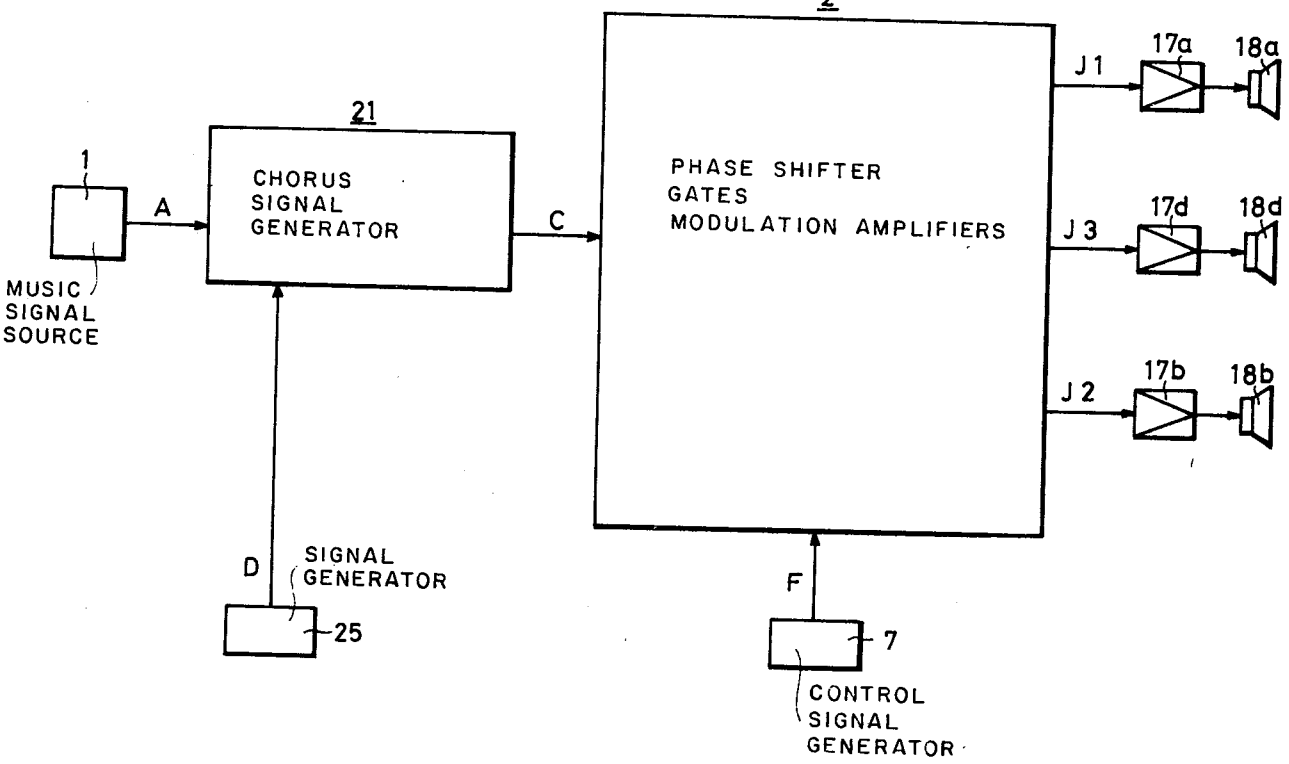
FIGS. 14 and 15 respectively show thirteenth and fourteenth embodiments of this invention.

FIG. 14 shows a thirteenth embodiment of this invention. In FIG. 14, parts corresponding to those in FIG. 6 are indicated by the same reference numerals and no detailed description will be given. This embodiment is identical in construction with the FIG. 6 embodiment except that the phase rotating signal generator or synthesizer 14 is omitted as is the case with FIG. 5, that a third speaker 18*d* is provided and that the sequentially phase inverting signals J1, J2 and J3 from the sequentially phase inverting signal generator 2 are respectively applied to the speakers 18*a*, 18*b* and 18*d*, if necessary, through the amplifiers 17*a*, 17*b* and 17*d*.

The above is the thirteenth embodiment of this invention. With the construction of this embodiment, if the speaker 18*d* is disposed between the speakers 18*a* and 18*b* as described previously in connection with FIG. 5 and as shown, the resultant sound composed of the sound reproduced by the speaker 18*a* based on the signal J1 and the sound reproduced by the speaker 18*d* based on the signal J3 is equivalent to the sound reproduced by the speaker 18*a* based on the signal K1 in the case of FIG. 6. And the resultant sound composed of the sound reproduced by the speaker 18*b* based on the signal J2 and the sound reproduced by the speaker 18*d* based on the signal J3 is equivalent to the sound reproduced by the speaker 18*b* based on the signal K2 in the case of FIG. 6.

Accordingly, with the thirteenth embodiment of this invention, too, it is possible to provide sounds which produce the pulsato effect together with the chorus effect as is the case with FIG. 6.

Figure 15:
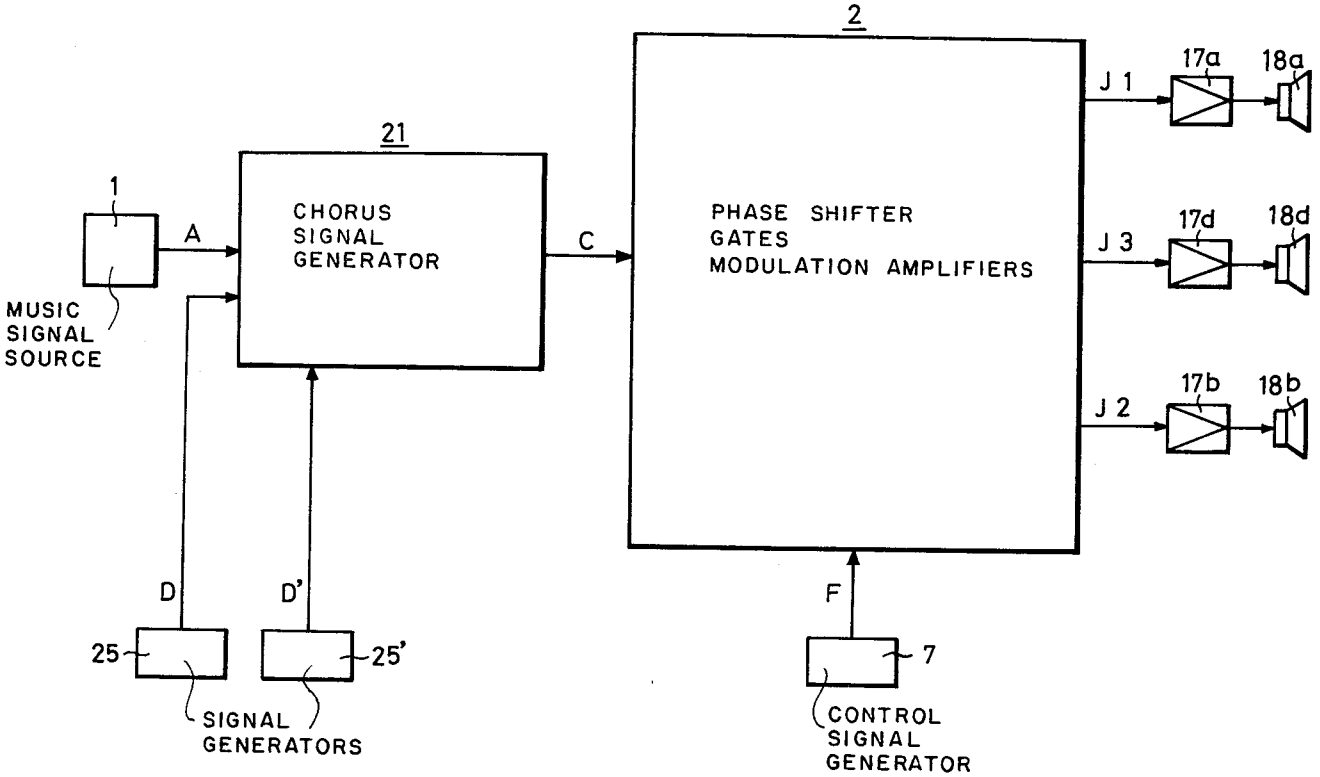

FIG. 15 illustrates a fourteenth embodiment of this invention. In FIG. 15, parts corresponding to those in FIG. 7 are indentified by the same reference numerals and no detailed description will be made. This embodiment is identical in construction with the FIG. 7 embodiment except that the phase rotating signal generator or synthesizer 14 is omitted, that a speaker 18*d* is provided and that the sequentially phase inverting signals J1, J2 and J3 from the sequentially phase inverting signal generator 2 are respectively supplied to the speakers 18*a*, 18*b* and 18*d*, if necessary, through the amplifiers 17*a*, 17*b* and 17*d*, as is the case with FIG. 14.

The above is the fourteenth embodiment of this invention. With such a construction, the sounds which produce the pulsato effect together with the chorus effect can be obtained in the same manner as in FIG. 7 for the same reasons as those given in connection with the thirteenth embodiment.

The foregoing examples are merely illustrative of this invention and should not be contrued as limiting the invention specifically thereto. For example, in the embodiments depicted in FIGS. 6, 8, 10, 11 and 14, it is possible to omit the control signal source 7 and, in such a case, for example, the control signal F for the sequentially phase inverting signal generator 2 can be replaced with the modulating signal D emanating from the modulating signal source 25. Further, it is also possible to obtain the gate signals G1 to G4 and the modulating signals I1 and I2 directly from the modulating signal D in the gate signal generator 17 and the modulating signal generator 20 of the sequentially phase inverting signal generator 2, respectively. In the embodiments of FIGS. 7, 9, 12 and 15, it is also possible to dispense with the control signal source 7 and to derive the gate signals G1 to G4 and the modulating signals I1 and I2 from the modulating signal D or D′ from the modulating signal source 25 or 25′, as is the case with the above.

Further, the amplitude modulating and synthesizing circuit 18 in the sequentially phase inverting signal generator 2 can also be modified in the following manner. Namely, the intermittent musical signals H1 and H3 are amplitude modulated by the modulating signal I1 in first and third amplitude modulators is phase inverted and then combined with the output from the first amplitude modulator to provide a composite signal, which is employed as the abovesaid composite signal J1. Moreover, the output from the first amplitude modulator is phase inverted and then combined with the output from the third amplitude modulator to provide a composite signal, which is used as the aforementioned composite signal J2. Further, the intermittent musical signals H2 and H4 are amplitude modulated by the modulating signal I2 in second and fourth amplitude modulators, respectively. The output from the fourth amplitude modulator is phase inverted and then combined with the output from the second amplitude modulator to provide a composite signal, which is employed as the aforesaid composite signal J3.

In the embodiments of FIGS. 8 and 9, it is also possible to supply the third speaker 18*c* with the composite signal C as a chorus signal obtained from the chorus signal generator 21 instead of supplying the musical signal A from the musical signal source 1.

In the embodiments of FIGS. 11 and 13, it is also possible to dispense with the modulating signal source 25″ for the chorus signal generator 32 and to derive a control signal D″ from the modulating signal source 25 or control signal source 7.

Further, in the embodiments to FIGS. 12 and 13, the frequency-modulated signal B to the chorus signal generator 32 can be replaced with the frequency-modulated signal B′.

It will be apparent that many modifications and variations may be effected without departing from the scope of the novel concepts of this invention.

What is claimed is:

1. A pulsato generating system comprising:

(I) a sequentially phase inverting signal generator for producing first, second and third sequentially phase inverting signals based on an input signal;

(II) a phase rotating signal generator for producing first and second phase rotating signals based on the first, second and third sequentially phase inverting signals; and (III) first and second speakers respectively supplied with the first and second phase rotating signals;

(IV) the sequentially phase inverting signal generator including:

(a) a phase shifter for obtaining from the input signal 0-phase and $\pi/2$-phase signals displaced $\pi/2$ in phase apart from each other;

(b) a gate signal generator for producing, from a low-frequency control signal, 0-phase, $\pi/2$-phase, $\pi$-phase and $3\pi/2$-phase rectangular gate signals whose frequencies are $\frac{1}{2}$ that of the low-frequency control signal and which are sequentially phase $\pi/2$ apart;

(c) gating means for gating the 0-phase signal by the 0-phase and $\pi$-phase gate signals to obtain first and second intermittent 0-phase signals and for gating the $\pi/2$-phase signal by the $\pi/2$-phase and $3\pi/2$-phase gate signals to obtain first and second intermittent $\pi/2$-signals;

(d) a modulating signal generator for producing from the control signal 0-phase and $\pi$-phase sine-wave modulating signals having the same frequency as the control signal and phased $\pi$ apart from each other; and (e) amplitude modulating and synthesizing means for producing first, second and third composite signals, as the first, second and third sequentially phase inverting signals, the first composite signal having such a mode of signal that a first intermittent 0-phase amplitude-modulated signal and a first intermittent $\pi$-phase amplitude-modulated signal are combined with each other, the first intermittent 0-phase amplitude-modulated signal being a signal that the first intermittent 0-phase signal is amplitude modulated by the 0-phase modulating signal, the first intermittent $\pi$-phase amplitude-modulated signal being a signal that the second intermittent 0-phase signal is amplitude modulated by the 0-phase modulating signal and phase inverted, the second composite signal having such a mode of signal that a second intermittent $\pi$-phase amplitude-modulated signal and a second intermittent 0-phase amplitude-modulated signal are combined with each other, the second intermittent $\pi$-phase amplitude-modulated signal being a signal that the first intermittent 0-phase signal is amplitude modulated by the 0-phase modulating signal and phase inverted, the second intermittent 0-phase amplitude-modulated signal being a signal that the second intermittent 0-phase signal is amplitude modulated by the 0-phase modulating signal, the third composite signal having such a mode of signal that an intermittent $\pi/2$-phase amplitude-modulated signal and an intermittent $3\pi/2$-phase amplitude-modulated signal are combined with each other, the intermittent $\pi/2$-phase amplitude-modulated signal being a signal that the first intermittent $\pi/2$-phase signal is amplitude modulated by the $\pi$-phase modulating signal, and the intermittent $3\pi/2$-phase amplitude-modulated signal being a signal that the second intermittent $\pi/2$-phase signal is amplitude modulated by the $\pi$-phase modulating signal and phase inverted; and (V) the phase rotating signal generator having first and second synthesizing circuits for producing fourth and fifth composite signals as the first and second phase rotating signals, respectively, the fourth composite signal being composed of the first and third sequentially phase inverting signals and the fifth composite signal being composed of the second and third sequentially phase inverting signals.

2. A pulsato generating system according to claim 1, which further comprises a third speaker supplied with the input signal.

3. A pulsato generating system comprising:

(I) a sequentially phase inverting signal generator for producing first, second and third sequentially phase inverting signals based on an input signal; and (II) first, second and third speakers respectively supplied with the first, second and third sequentially phase inverting signals;

(III) the sequentially phase inverting signal generator including:

(a) a phase shifter for obtaining from the input signal 0-phase and $\pi/2$-phase signals displaced 90/2 in phase apart from each other;

(b) a gate signal generator for producing, from a low-frequency control signal , 0-phase, $\pi/2$-phase, $\pi$-phase and $3\pi/2$-phase rectangular gate signals whose frequencies are $\frac{1}{2}$ that of the low-frequency control signal and which are sequentially phased $\pi/2$ apart;

(c) gating means for gating the 0-phase signal by the 0-phase and $\pi$-phase gate signals to obtain first and second intermittent 0-phase signals and for gating the $\pi/2$-phase signal by the $\pi/2$-phase and $3\pi/2$-phase gate signals to obtain first and second intermittent $\pi/2$-phase signals;

(d) a modulating signal generator for producing from the control signal 0-phase and $\pi$-phase sine-wave modulating signals having the same frequency as the control signal and phased $\pi$ apart from each other; and (e) amplitude modulating and synthesizing means for producing first, second and third composite signals, as the first, second and third sequentially phase inverting signals, the first composite signal having such a mode of signal that a first intermittent 0-phase amplitude-modulated signal and a first intermittent $\pi$-phase amplitude-modulated signal are combined with each other, the first intermittent 0-phase amplitude-modulated signal being a signal that the first intermittent 0-phase signal is amplitude modulated by the 0-phase modulating signal, the first intermittent $\pi$-phase amplitude-modulated signal being a signal that the second intermittent 0-phase signal is amplitude modulated by the 0-phase modulating signal and phase inverted, the second composite signal having such a mode of signal that a second intermittent $\pi$-phase amplitude-modulated signal and a second intermittent 0-phase amplitude-modulated signal are combined with each other, the second intermittent $\pi$-phase amplitude-modulated signal being a signal that the first intermittent 0-phase signal is amplitude modulated by the 0-phase modulating signal and phase inverted, the second intermittent 0-phase amplitude-modulated signal being a signal that the second intermittent 0-phase signal is amplitude modulated by the 0-phase modulating signal, the third composite signal having such a mode of signal that an intermittent $\pi/2$-phase amplitude-modulated signal and an intermittent $3\pi/2$-phase amplitude-modulated signal are combined with each other, the intermittent $\pi/2$-phase amplitude-modulated signal being a signal that the first intermittent $\pi/2$-phase signal is amplitude modulated by the $\pi$-phase modulating signal, and the intermittent $3\pi/2$-phase amplitude-modulated signal being a signal that the second intermittent $\pi/2$-phase signal is amplitude modulated by the $\pi$-phase modulating signal and phase inverted.

4. A signal generator for pulsato comprising:

(I) a phase shifter for obtaining from the output signal 0-phase and $\pi/2$-phase signals displaced $\pi/2$ in phase apart from each other;

(II) a gate signal generator for producing, from a low-frequency control signal, 0-phase, $\pi/2$-phase, $\pi$-phase and $3\pi/2$-phase rectangular gate signals whose frequencies are $\frac{1}{2}$ that of the low-frequency control signal and which are sequentially phased $\pi/2$ apart;

(III) gating means for gating the 0-phase signal by the 0-phase and $\pi$-phase gate signals to obtain first and second intermittent 0-phase signals and for gating the $\pi/2$-phase signal by the $\pi/2$-phase and $3\pi/2$-phase gate signals to obtain first and second intermittent $\pi/2$-phase signals;

(IV) a modulating signal generator for producing from the control signal 0-phase and $\pi$-phase sine-wave modulating signals having the same frequency as the control signal and phased $\pi$ apart from each other; and (V) amplitude modulating and synthesizing means for producing first, second and third composite signals, as the first, second and third sequentially phase inverting signals, the first composite signal having such a mode of signal that a first intermittent 0-phase amplitude-modulated signal and a first intermittent $\pi$-phase amplitude-modulated signal are combined with each other, the first intermittent 0-phase amplitude-modulated signal being a signal that the first intermittent 0-phase signal is amplitude modulated by the 0-phase modulating signal, the first intermittent $\pi$-phase amplitude-modulated signal being a signal that the second intermittent 0-phase signal is amplitude modulated by the 0-phase modulating signal and phase inverted, the second composite signal having such a mode of signal that a second intermittent $\pi$-phase amplitude-modulated signal and a second intermittent 0-phase amplitude-modulated signal are combined with each other, the second intermittent $\pi$-phase amplitude-modulated signal being a signal that the first intermittent 0-phase signal is amplitude modulated by the 0-phase modulating signal and phase inverted, the second intermittent 0-phase amplitude-modulated signal being a signal that the second intermittent 0-phase signal is amplitude modulated by the 0-phase modulating signal, the third composite signal having such a mode of signal that an intermittent $\pi/2$-phase amplitude-modulated signal and an intermittent $3\pi/2$-phase amplitude-modulated signal are combined with each other, the intermittent $\pi/2$-phase amplitude-modulated signal being a signal that the first intermitten $\pi/2$-phase signal is amplitude modulated by the $\pi$-phase modulating signal, and the intermittent $3\pi/2$-phase amplitude-modulated signal being a signal that the second intermittent $\pi/2$-phase signal is amplitude modulated by the $\pi$-phase modulating signal and phase inverted;

5. A signal generator for pulsate according to claim 4, which further comprises a phase rotating signal generator having first and second synthesizing circuits for producing fourth and fifth composite signals as first and second phase rotating signals, respectively, the fourth composite signal being composed of the first and third sequentially phase inverting signals and the fifth composite signal being composed of the second and third sequentially phase inverting signals.

6. A pulsato generating system comprising:

(I) a chorus signal generator for producing a first chorus signal from an input signal;

(II) a sequentially phase inverting signal generator for producing first, second and third sequentially phase inverting signals based on the first chorus signal;

(III) a phase rotating signal generator for producing first and second phase rotating signals based on the first, second and third sequentially phase inverting signals; and (IV) first and second speakers respectively supplied with the first and second phase rotating signals;

(V) the chorus signal generator including:

(a) a first frequency modulating circuit for frequency modulating the input signal by a first sinusoidal wave modulating signal of a low frequency to produce a first frequency-modulated signal; and (b) a first synthesizing circuit for producing, as the first chorus signal, a first composite signal composed of the first frequency-modulated signal and the input signal;

(VI) the sequentially phase inverting signal generating including:

(a) a phase shifter for obtaining from the first chorus signal 0-phase and $\pi/2$-phase signals displaced $\pi/2$ in phase apart from each other;

(b) a gate signal generator for producing, from a selected one of the first modulating signal and a low-frequency control signal, 0-phase, $\pi/2$-phase, $\pi$-phase and 3 $\pi/2$-phase rectangular gate signals whose frequencies are $\frac{1}{2}$ that of the selected one of the first modulating signal and the low-frequency control signal and which are sequentially phase $\pi/2$ apart;

(c) gating means for gating the 0-phase signal by the 0-phase and $\pi$-phase gate signals to obtain first and second intermittent 0-phase signals and for gating the $\pi/2$-phase signal by the $\pi/2$-phase and the 3 $\pi/2$-phase gate signals to obtain first and second intermittent $\pi/2$-phase signals;

(d) a modulating signal generator for producing, from the selected one of the first modulating signal and the control signal, 0-phase and $\pi$-phase sine-wave modulating signals having the same frequency as the selected one of the first modulating signal and the control signal and phased $\pi$ apart from each other; and (e) amplitude modulating and synthesizing means for producing second, third and fourth composite signals, as the first, second and third sequentially phase inverting signals, the second composite signal having such a mode of signal that a first intermittent 0-phase amplitude-modulated signal and a first intermittent $\pi$-phase amplitude-modulated signal are combined with each other, the first intermittent 0-phase amplitude-modulated signal being a signal that the first intermittent 0-phase signal is amplitude modulated by the 0-phase modulating signal, the first intermittent $\pi$-phase amplitude-modulated signal being a signal that the second intermittent 0-phase signal is amplitude modulated by the 0-phase modulating signal and phase inverted, the third composite signal having such a mode of signal that a second intermittent $\pi$-phase amplitude-modulated signal and a second intermittent 0-phase amplitude-modulated signal are combined with each other, the second intermittent $\pi$-phase amplitude-modulated signal being a signal that the first intermittent 0-phase signal is amplitude modulated by the 0-phase modulating signal and phase inverted, the second intermittent 0-phase amplitude-modulated signal being a signal that the second intermittent 0-phase signal is amplitude modulated by the 0-phase modulating signal, the fourth composite signal having such a mode of signal that an intermittent $\pi/2$-phase amplitude-modulated signal and an intermittent $3\pi/2$-phase amplitude-modulated signal are combined with each other, the intermittent $\pi/2$-phase amplitude-modulated signal being a signal that the first intermittent $\pi/2$-phase signal is amplitude modulated by the $\pi$-phase modulating signal, and the intermittent 3 $\pi/2$-phase amplitude-modulated signal being a signal that the second intermittent $\pi/2$-phase signal is amplitude modulated by the $\pi$-phase modulating signal and phase inverted; and (VII) the phase rotating signal generator having second and third synthesizing circuits for producing fifth and sixth composite signals as the first and second phase rotating signals, respectively, the fifth composite signal being composed of the first and third sequentially phase inverting signals and the sixth composite signal being composed of the second and third sequentially phase inverting signals.

7. A pulsato generating system comprising:

(I) a chorus signal generator for producing a first chorus signal from an input signal;

(II) a sequentially phase inverting signal generator for producing first, second and third sequentially phase inverting signals based on the first chorus signal;

(III) a phase rotating signal generator for producing first and second phase rotating signals based on the first, second and third sequentially phase inverting signals; and (IV) first and second speakers respectively supplied with the first and second phase rotating signals;

(V) the chorus signal generator including:

(a) a first frequency modulating circuit for frequency modulating the input signal by a first sinusoidal wave modulating signal of a low frequency to produce a first frequency-modulated signal;

(b) a second frequency modulating circuit for frequency modulating the input signal by a second sinusoidal-wave modulating signal to produce a second frequency-modulating signal; and (c) a first synthesizing circuit for producing, as the first chorus signal, a first composite signal composed of the first and second frequency-modulated signals and the input signal;

(VI) the sequentially phase inverting signal generator including:

(a) a phase shifter for obtaining from the first chorus signal 0-phase and $\pi/2$-phase signals displaced $\pi/2$ in phase apart from each other;

(b) a gate signal generator for producing, from a selected one of the first modulating signal, the second modulating signal, and a low-frequency control signal, 0-phase, $\pi/2$-phase, $\pi$-phase and 3 $\pi/2$-phase rectangular gate signals whose frequencies are $\frac{1}{2}$ that of the selected one of the signals and sequentially phased $\pi/2$apart;

(c) gating means for gating the 0-phase signals by the 0-phase and $\pi$-phase gate signals to obtain first and second intermittent 0-phase signals and for gating the $\pi/2$-phase signal by the $\pi/2$-phase and 3 $\pi/2$-phase gate signals to obtain first and second intermittent $\pi/2$-phase signals;

(d) a modulating signal generator for producing, from a selected one of the first modulating signal, the second modulating signal, and the control signal, 0-phase and $\pi$-phase sine-wave modulating signals having the same frequency as the selected signal and phased $\pi$ apart from each other; and (e) amplitude modulating and synthesizing means for producing second, third and fourth composite signals as the first, second and third sequentially phase inverting signals, the second composite signal having such a mode of signal that a first intermittent 0-phase amplitude-modulated signal and a first intermittent $\pi$-phase amplitude-modulated signal are combined with each other, the first intermittent 0-phase amplitude-modulated signal being a signal that the first intermittent 0-phase signal is amplitude modulated by the 0-phase modulating signal, the first intermittent $\pi$-phase amplitude-modulated signal being a signal that the second intermittent 0-phase signal is amplitude modulated by the 0-phase modulating signal and phase inverted, the third composite signal having such a mode of signal that a second intermittent $\pi$-phase amplitude-modulated signal and a second intermittent 0-phase amplitude-modulated signal are combined with each other, the second intermittent $\pi$-phase amplitude-modulated signal being a signal that the first intermittent 0-phase signal is amplitude modulated by the 0-phase modulating signal and phase inverted, the second intermittent 0-phase amplitude-modulated signal being a signal that the second intermittent 0-phase signal is amplitude modulated by the 0-phase modulating signal, the fourth composite signal having such a mode of signal that an intermittent $\pi/2$-phase amplitude-modulated signal and an intermittent 3 $\pi/2$-phase amplitude-modulated signal are combined with each other, the intermittent $\pi/2$-phase amplitude-modulated signal being a signal that the first intermittent $\pi/2$-phase signal is amplitude modulated by the $\pi$-phase modulating signal, and the intermittent 3 $\pi/2$-phase amplitude-modulated signal being a signal that the second intermittent $\pi/2$-phase signal is amplitude modulated by the $\pi$-phase modulating signal and phase inverted; and (VII) the phase rotating signal generator having second and third synthesizing circuits for producing fifth and sixth composite signals as the first and second phase rotating signals, respectively, the fifth composite signal being composed of the first and third sequentially phase inverting signals and the sixth composite signal being composed of the second and third sequentially phase inverting signals.

8. A pulsato generating system comprising:

(I) a chorus signal generator for producing a first chorus signal from an input signal;

(II) a sequentially phase inverting signal generator for producing first, second and third sequentially phase inverting signals based on the first chorus signal; and (III) first second and third speakers respectively supplied with the first, second and third sequentially phase inverting signals;

(IV) the chorus signal generator including:

(a) a first frequency modulating circuit for frequency modulating the input signal by a first sinusoidal-wave modulating signal of a low frequency to produce a first frequency-modulated signal; and (b) a first synthesizing circuit for producing, as the first chorus signal, a first composite signal composed of the first frequency-modulated signal and the input signal; and (V) the sequentially phase inverting signal generator including:

(a) a phase shifter for obtaining from the first chorus signal 0-phase and $\pi/2$-phase signals displaced $\pi/2$ in phase apart from each other;

(b) a gate signal generator for producing, from a selected one of the first modulating signal and a low-frequency control signal, 0-phase $\pi/2$-phase, $\pi$-phase and 3 $\pi/2$-phase rectangular gate signals whose frequencies are $\frac{1}{2}$ that of the selected one of first modulating signal and the low-frequency control signal and which are sequentially phase $\pi/2$ apart;

(c) gating means for gating the 0-phase signal by the 0-phase and $\pi$-phase gate signals to obtain first and second intermittent 0-phase signals and for gating the $\pi/2$-phase signal by the $\pi/2$-phase and 3 $\pi/2$-phase gate signals to obtain first and second intermittent $\pi/2$-phase signals;

(d) a modulating signal generator for producing, from the inverted one of the first modulating signal and the control signal, 0-phase and $\pi$-phase sine-wave modulating signals having the same frequency as the selected one of the first modulating signal and the control signal and phased $\pi$ apart from each other; and (e) amplitude modulating and synthesizing means for producing second, third and fourth composite signals, as the first, second and third sequentially phase inverting signals, the second composite signal having such a mode of signal that a first intermittent 0-phase amplitude-modulated signal and a first intermittent $\pi$-phase amplitude-modulated signal are combined with each other, the first intermittent 0-phase amplitude-modulated signal being a signal that the first intermittent 0-phase signal is amplitude modulated by the 0-phase modulating signal, the first intermittent $\pi$-phase amplitude-modulated signal being a signal that the second intermittent 0-phase signal is amplitude modulated by the 0-phase modulating signal and phase inverted, the third composite signal having such a mode of signal that a second intermittent $\pi$-phase amplitude-modulated signal and a second intermittent 0-phase amplitude-modulated signal are combined with each other, the second intermittent $\pi$-phase amplitude-modulated signal being a signal that the first intermittent 0-phase signal is amplitude modulated by the 0-phase modulating signal and phase inverted, the second intermittent 0-phase amplitude-modulated signal being a signal that the second intermittent 0-phase signal is amplitude modulated by the 0-phase modulating signal, the fourth composite signal having such a mode of signal that an intermittent $\pi/2$-phase amplitude-modulated signal and an intermittent 3 $\pi/2$-phase amplitude-modulated signal are combined with each other, the intermittent $\pi/2$-phase amplitude-modulated signal being a signal that the first intermittent $\pi/2$-phase signal is amplitude modulated by the $\pi$-phase modulating signal, and the intermittent 3 $\pi/2$-phase amplitude-modulated signal being a signal that the second intermittent $\pi/2$-phase signal is amplitude modulated by the $\pi$-phase modulating signal and phase inverted.

9. A pulsato generating system comprising:

(I) a chorus signal generator for producing a first chorus signal from an input signal;

(II) a sequentially phase inverting signal generator for producing first, second and third sequentially phase inverting signals based on the first chorus signal; and (III) first, second and third speakers respectively supplied with the first, second and third sequentially phase inverting signals;

(IV) the chorus signal generator including:

(a) a first frequency modulating circuit for frequency modulating the input signal by a first sinusoidal-wave modulating signal of a low frequency to produce a first frequency-modulated signal;

(b) a second frequency modulating circuit for frequency modulating the input signal by a second sinusoidal-wave modulating signal to produce a second frequency-modulated signal; and (c) a first synthesizing circuit for producing, as the first chorus signal, a first composite signal composed of the first and second frequency-modulated signals and the input signal; and (V) the sequentially phase inverting signal generator including:

(a) a phase shifter for obtaining from the first chorus signal 0-phase and $\pi/2$-phase signals displaced $\pi/2$ in phase apart from each other;

(b) a gate signal generator for producing, from a selected one of the first modulating signal, second modulating signal, and a low-frequency control signal, 0-phase, $\pi/2$-phase, $\pi$-phase and $3\pi/2$-phase rectangular gate signals whose frequencies are ½ that of the selected one of first or second modulating signal or the low-frequency control signal and sequentially phased $\pi/2$ apart;

(c) gating means for gating the 0-phase signals by the 0-phase and $\pi$-phase gate signals to obtain first and second intermittent 0-phase signals and for gating the $\pi/2$-phase signal by the $\pi/2$-phase and 3 $\pi/2$-phase gate signals to obtain first and second intermittent $\pi/2$-phase signals;

(d) a modulating signal generator for producing, from a selected one of the first modulating signal, or second modulating signal, and the control signal, 0-phase and $\pi$-phase sine-wave modulating signals having the same frequency as the selected first or second modulating signal or control signal and phased apart from each othere; and (e) amplitude modulating and synthesizing means for producing second, third and fourth composite signals as the first, second and third sequentially phase inverting signals, the second composite signal having such a mode of signal that a first intermittent 0-phase amplitude-modulated signal and a first intermittent $\pi$-phase amplitude-modulated signal are combined with each other, the first intermittent 0-Phase amplitude-modulated signal being a signal that the first intermittent 0-phase signal is amplitude modulated by the 0-phase modulating signal, the first intermittent $\pi$-phase amplitude-modulated signal being a signal that the second intermittent 0-phase signal is amplitude modulated by the 0-phase modulating signal and phase inverted, the third composite signal having such a mode of signal that a second intermittent $\pi$-phase amplitude-modulated signal and a second intermittent 0-phase amplitude-modulated signal are combined with each other, the second intermittent $\pi$-phase amplitude-modulated signal being a signal that the first intermittent 0-phase signal is amplitude modulated by the 0-phase modulating signal and phase inverted, the second intermittent 0-phase amplitude-modulated signal being a signal that the second intermittent 0-phase signal is amplitude modulated by the 0-phase modulating signal, the fourth composite signal having such a mode of signal that an intermittent $\pi/2$-phase amplitude-modulated signal and an intermittent 3 $\pi/2$-phase amplitude-modulated signal are combined with each other, the intermittent $\pi/2$-phase amplitude-modulated signal being a signal that the first intermittent $\pi/2$-phase signal is amplitude modulated by the $\pi$-phase modulating signal and the intermittent 3 $\pi/2$-phase amplitude-modulated signal being a signal that the second intermittent $\pi/2$-phase signal is amplitude modulated by the $\pi$-phase modulating signal and phase inverted.

* * * * *